US007598929B2

(12) United States Patent
Ohnuki et al.

(10) Patent No.: US 7,598,929 B2
(45) Date of Patent: Oct. 6, 2009

(54) PLASMA DISPLAY APPARATUS

(75) Inventors: Hidenori Ohnuki, Kawasaki (JP); Yoshinori Okada, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 745 days.

(21) Appl. No.: 10/900,342

(22) Filed: Jul. 28, 2004

(65) Prior Publication Data

US 2005/0077834 A1 Apr. 14, 2005

(30) Foreign Application Priority Data

Oct. 14, 2003 (JP) ..... 2003-353761
Jan. 28, 2004 (JP) ..... 2004-019650

(51) Int. Cl.
*G09G 3/28* (2006.01)

(52) U.S. Cl. ..... 345/60; 315/169.4

(58) Field of Classification Search ..... 345/60–88, 345/37, 32; 315/169.4
See application file for complete search history.

(56) References Cited

U.S. PATENT DOCUMENTS 5,440,304 A 8/1995 Hirai
6,344,841 B1 * 2/2002 Moon ..... 345/60
6,373,452 B1 4/2002 Ishii et al.
6,448,947 B1 * 9/2002 Nagai ..... 345/60
6,956,546 B1 * 10/2005 Hashimoto et al. ..... 345/60
7,075,528 B2 * 7/2006 Sano et al. ..... 345/211
2002/0075214 A1 6/2002 Kim
2002/0089472 A1 * 7/2002 Tsai ..... 345/60
2003/0001801 A1 * 1/2003 Setoguchi et al. ..... 345/60
2003/0218580 A1 * 11/2003 Yokoyama et al. ..... 345/60

FOREIGN PATENT DOCUMENTS

JP 62-42193 2/1987
JP 3-49255 3/1991
JP 4-168417 6/1992
JP 6-180558 6/1994

(Continued)

OTHER PUBLICATIONS

Chinese Patent Office Action, mailed Jan. 5, 2007, and issued in corresponding Chinese Patent Application No. 200410057233.1.
Communication from the Japanese Patent Office issued on Jan. 27, 2009 in the corresponding Japanese patent application.
Communication issued from the Japanese Patent Office on Apr. 14, 2009 in the corresponding Japanese patent application.

(Continued)

*Primary Examiner*—Richard Hjerpe
*Assistant Examiner*—Mansour M Said
(74) *Attorney, Agent, or Firm*—Staas & Halsey LLP

(57) ABSTRACT

A PDP apparatus in which a large-sized plasma display panel, whose electrodes have large drive requirements, is driven by using already existing driver ICs, and a PDP apparatus in which the operating conditions when a plasma display panel is driven by using a plurality of driver ICs have been improved, are disclosed. According to a first aspect, one electrode of the plasma display panel is driven by combining a plurality of drive signals output from the driver IC and, according to a second aspect, in a configuration in which a plurality of electrodes are driven by a plurality of identical driver ICs, when some of a plurality of outputs of the driver ICs are not connected to the electrodes and not used, the unused outputs are distributed in each driver IC as evenly as possible.

11 Claims, 20 Drawing Sheets

FOREIGN PATENT DOCUMENTS

| | | |
|---|---|---|
| JP | 8-316813 | 1/1996 |
| JP | 2002-090768 | 3/2002 |
| JP | 2002-304151 | 10/2002 |
| JP | 2002-328390 | 11/2002 |
| JP | 2003-29701 | 1/2003 |

OTHER PUBLICATIONS

Communication from the European Patent Office dated Jul. 1, 2009 in the related European patent application.

* cited by examiner

Prior Art

Prior Art

Prior Art

Prior Art

Prior Art

PLASMA DISPLAY APPARATUS

BACKGROUND OF THE INVENTION

The present invention relates to a plasma display apparatus (a PDP apparatus) used as a display unit for a personal computer or work station, a flat TV, or a plasma display for displaying advertisements, information, etc.

AC-type color PDP apparatuses include various types and systems such as two- or three-electrode types, an address/display non-separation system in which a period (address period) during which cells to be lit are selected and a display period (sustain period) during which a discharge is caused to occur for light emission to produce a display are shifted sequentially, and an address/display separation system in which the address period and the sustain period are separated from each other. In most systems, a PDP apparatus has at least a configuration in which a plurality of electrodes arranged in parallel to each other intersect another plurality of electrodes, and in this configuration, it is necessary to drive each electrode independently. The present invention can be applied to any PDP apparatus employing any system provided that the PDP apparatus has a configuration in which such a plurality of electrodes are driven independently. Here, a three-electrode type address/display separation system PDP apparatus, which is currently in practical use and is most widely used, is taken as an example in the following explanation. However, the present invention is not limited to this type.

FIG. 1 is a diagram showing a fundamental configuration of a three-electrode type address/display separation system PDP apparatus. On a first substrate making up a plasma display panel 10, sustain (X) electrodes and scan (Y) electrodes are provided by turns in parallel to each other and they are covered with a dielectric layer. On a second substrate facing the first substrate, address electrodes extending in a direction perpendicular to the X and Y electrodes are provided and the surfaces of the electrodes are covered with a dielectric layer. Further, on the second substrate, stripe-shaped partitions extending in parallel to the address electrodes are arranged between the address electrodes, or two-dimensional grid-shaped partitions arranged between the address electrodes and between the pairs of the X and Y electrodes are provided and, after phosphor layers are formed in grooves in the partitions, the first and second substrates are bonded together to each other at a predetermined distance. Discharge spaces are formed between the first and second substrates and a discharge gas, which is a mixture of neon, xenon, etc., is enclosed therein. A display cell is defined at the intersection of a pair of neighboring X and Y electrodes and the address electrode. In a PDP apparatus employing a normal system rather than an ALIS system, which will be described later, a display cell is defined between a pair of X and Y electrodes, and no display cell is defined between neighboring pairs of X and Y electrodes.

As shown in FIG. 1, the PDP apparatus comprises, besides the plasma display panel 10, an address driver 11 for driving the address electrodes, a Y scan driver 12 for driving the Y electrodes, a Y sustain circuit 13 for supplying a Y sustain signal to the Y scan driver 12, an X sustain circuit 14 that drives so as to supply an X sustain signal to the X electrodes, and a control circuit 15 for controlling each part. As shown schematically, the X sustain circuit 14 has only one output and drives the commonly connected X electrodes. In contrast to this, the Y scan driver 12 drives each of the Y electrodes independently and the address driver 11 drives each of the address electrodes independently.

FIG. 2 is a diagram showing drive waveforms in the PDP apparatus shown in FIG. 1. A fundamental drive sequence of an address/display separation system PDP apparatus comprises a reset period during which all of the display cells are put into a uniform state, an address period during which display cells to be lit are selected, and a sustain period during which the selected display cells are made to emit light. In the PDP apparatus, only the selection of a lit state or unlit state of each display cell can be made and the control of the intensity of light emission is not possible. Hence, one display frame is made up of a plurality of subfields having the fundamental drive sequence as shown in FIG. 2, and a lit state or unlit state of each display cell is selected in each subfield, and a gradated display is produced by combining the luminance of each subfield. In order to efficiently produce a gradated display, the ratio of luminance of each subfield, that is, the ratio of the number of sustain pulses to be applied during the sustain period in each subfield, is set that each term differs from another. For example, the ratios are 1:2:4:8.

As shown in FIG. 2, during the reset period, a voltage Va is applied to each of the address electrodes, a voltage Vw is applied to the common X electrodes, and 0 V is applied to each of the Y electrodes. Due to this, a discharge is caused to occur between the X electrode and the Y electrode and between the address electrode and the Y electrode in each of the display cells and all of the display cells are put into a uniform state. During the following address period, in a state in which a voltage Vx is applied to the common X electrodes and a voltage −Vyl is applied to each of the Y electrodes, a scan pulse having a voltage −Vy is applied sequentially to the Y electrodes and an address pulse having the voltage va is applied to the address electrode in a display cell to be lit in synchronization with the application of a scan pulse. An address discharge is caused to occur between the Y electrode to which a scan pulse has been applied and the address electrode to which an address pulse has been applied, and wall charges are accumulated on the surface of the dielectric layer on the electrode in the display cell to be lit. By applying an address pulse while sequentially applying a scan pulse to each of the Y electrodes, the display cells to be lit are selected in the entire surface. During the sustain period, in a state in which the voltage Va is applied to the address electrode, a sustain pulse having a voltage Vs is applied alternately to the Y electrode and the X electrode. In the display cell in which wall charges have been formed during the address period, a sustain discharge is caused to occur because the voltage due to the wall charges is added to the voltage Vs of a sustain pulse and the discharge start voltage is exceeded, but in the cell in which wall charges have not been formed during the address period, a sustain discharge is not caused to occur because there is no voltage due to wall charges and the voltage Vs of a sustain pulse alone is not sufficient to exceed the discharge start voltage. In the display cell in which a sustain discharge has been caused to occur, wall charges having the opposite polarity are formed by the sustain discharge, therefore, if a sustain pulse is applied to the X electrode, a sustain discharge is caused to occur. If, in this manner, a sustain pulse is applied repeatedly, a sustain discharge is caused to occur repeatedly in the selected display cell.

The configuration and drive waveforms of the PDP apparatus explained in FIG. 1 and FIG. 2 are only examples, and other various configurations and drive methods have been proposed. Although no detailed explanation will be given here, the present invention can be applied to any PDP apparatus.

FIG. 3 is a diagram showing an example of a configuration of each drive circuit in the PDP apparatus explained in FIG. 1 and FIG. 2. The address driver 11 has driver circuits 16 consisting of two transistors AT1 and AT2 connected in series between a power source of the voltage Va and a GND power source, the number of the driver circuits 16 being equal to that of the address electrodes. The connection node of the transistors AT1 and AT2 is connected to each address electrode. When the transistor AT1 is turned on, the voltage Va is applied to the address electrode and when the transistor AT2 is turned on, 0 V is applied to the address electrode.

The Y scan driver 12 has driver circuits 17 consisting of two transistors ST1 and ST2 connected in series between a power source of the voltage −Vy1 and a power source of the voltage −Vy, and two diodes D1 and D2 connected to the connection node of the two transistors ST1 and ST2, the number of the driver circuits 17 being equal to that of the Y electrodes. The diode D1 is connected to a GND power source via a transistor in the Y sustain circuit 13 and the diode D2 is connected to a power source of the voltage Vs via a transistor in the Y sustain circuit 13. During the address period, both the transistors in the Y sustain circuit 13 are turned off and the voltage −Vy1 is output by turning the transistor ST1 on, and when a scan pulse is applied, the ST1 is turned off and at the same time the ST2 is turned on. During the sustain period, both the ST1 and ST2 are turned off and the two transistors in the Y sustain circuit 13 are turned on and off by turns. Due to this, the voltages Vs and GND are applied by turns from the Y sustain circuit 13 via the diodes D1 and D2.

The X sustain circuit 14 has four transistors serving as switches for making connections to the voltages Vw, Vx, Vs and 0 V (GND), respectively, and the respective voltages can be applied to the X electrode by turning on the respective transistors.

As a sustain discharge is caused to occur between the X electrode and the Y electrode, the X electrode and the Y electrode are called the sustain electrode. As a scan pulse is applied to the Y electrode, the Y electrode is called the scan electrode. The Y electrode is called the scan electrode and the X electrode is called the sustain electrode here.

As described above, the Y scan driver 12 has the driver circuits 17 consisting of the two transistors ST1 and ST2 and the two diodes D1 and D2, the number of the driver circuits 17 being equal to that of the scan (Y) electrodes, and a scan pulse is output sequentially from each driver circuit 17. Because of this, the Y scan driver 12 further comprises a shift register, which shifts a signal indicating the output position of a scan pulse sequentially, and the output of the shift register is inputted to the plurality of the scan driver circuits 17. The address driver 11 has the driver circuits 16 consisting of the transistors AT1 and AT2, the number of the driver circuits 16 being equal to that of the address electrodes and an address pulse is output from each driver circuit 16. Because of this, the address driver 11 further comprises a shift register, which shifts address data sequentially, and the output of the shift register is inputted to the plurality of the driver circuits 16 when the shift operation corresponding to the length of the address data is completed.

As described above, a shift register for setting data to be output is, in general, necessary for a driver that outputs a plurality of drive signals independently. In general, therefore, the Y scan driver 12 and the address driver 11 are realized by using driver ICs, into which a shift register, a latch circuit for latching the output of the shift register and a plurality of driver circuits for outputting a drive signal corresponding to the output of the latch circuit have been integrated. By the way, it is not necessary to provide a diode to a driver IC to be used in the address driver 11 but a driver IC to be used in the Y scan driver 12 is provided with diodes.

The number of driver circuits provided in a driver IC is 16 or 64, and currently, a driver IC having 64 driver circuits is widely used and, corresponding to this, a 64-bit shift register or latch circuit is provided. For example, if the plasma display panel shown in FIG. 1 has a configuration in which 1,024× 768 display cells are arranged, the scan driver 12 is made up of twelve 64-bit driver ICs in a cascade connection. The address driver 11 is made up of sixteen 64-bit driver ICs and each bit of 16-bit display data is supplied to each IC, and the sixteen 64-bit driver ICs are operated in parallel.

FIG. 4 is a diagram showing a configuration of a driver IC 21. A 64-bit driver IC is considered here. As shown schematically, the IC 21 comprises a 64-bit shift register 22 for shifting input data Din sequentially in accordance with a clock CLK, a 64-bit latch 23 for latching the output of the 64-bit shift register in accordance with a latch enable signal LE, 64 output drivers 24-1 to 24-64 for outputting a drive signal in accordance with each of the 64 outputs of the 64-bit latch 23, and diodes D1-1 to D1-64 and D2-1 to D2-64 connected between each output of the 64 output drivers 24-1 to 24-64 and a power source terminal VL and between that and a power source terminal VH, respectively. The 64 output drivers 24-1 to 24-64 select and output each output of the 64 outputs of the 64-bit latch 23 or the output is put into a high-impedance (Hi-Z) state in accordance with an output control signal OC. To be specific, when used as the Y scan driver, the outputs of the output drivers 24-1 to 24-64 become Hi-Z during the sustain period, and during the address period, the output drivers 24-1 to 24-64 output in accordance with each of the 64 outputs of the 64-bit latch 23. During the sustain period, the GND and the sustain voltage Vs are supplied alternately to power terminals VH1 to VH64 and VL1 to VL64 and a sustain pulse is applied to the respective scan electrodes through the respective diodes D1-1 to D1-64 and D2-1 to D2-64. Due to this, the diodes D1-1 to D1-64 and D2-1 to D2-64 produce heat but the amount of heat produced relates to the drive capacity and discharge current of the scan electrode and a problem is brought about: if the drive capacity and discharge current of the scan electrode are large, the amount of heat produced will become accordingly large.

It is desirable that the specifications of a driver IC, such as drive performance and the number of bits, are specified in accordance with the specifications of a PDP apparatus as a product, but there arise problems: if the number of the PDP apparatus to be-manufactured is not so large, the number of the driver ICs having the proper specifications is not sufficiently large, resulting in a high cost; and a long period of time is required for commercially introducing a new driver IC. Therefore, if a dedicated IC is designed and made commercially available after the specifications of a PDP apparatus are determined, the shipment of the PDP apparatus is delayed and sales chances will be missed. Hence, there may be a case where a driver circuit for a PDP apparatus is realized by using already manufactured driver ICs that have already been made commercially available.

The configuration and drive waveforms of the PDP apparatus explained in FIG. 1 and FIG. 2 are only one example, and other various configurations and drive methods have been proposed. In Japanese Unexamined Patent Publication (Kokai) No. 9-160525, an ALIS system plasma display apparatus (PDP apparatus) has been disclosed, in which the number of display lines can be doubled using the same number of X electrodes and Y electrodes of the conventional PDP apparatus. The details of the configuration of an ALIS system PDP apparatus will be described later. FIG. 5 shows wiring between Y electrodes and driver IC outputs in an ALIS system PDP apparatus, in which a Y scan driver has been realized by using the driver ICs shown in FIG. 4. The plasma display panel (PDP) 10 used here comprises 385 sustain electrodes and 384 scan electrodes, and 768 display lines are defined. The Y scan driver is mounted on a film and connected to the Y electrode terminals of the PDP 10 by thermal compression bonding using an anisotropic conductive film but, because of the conditions on the thermal compression bonding apparatus and the connection performance, the 384 Y electrodes are divided into two blocks each having 192 Y electrodes and are connected to the driver ICs through two groups of output terminals C1 and C2. In an ALIS system PDP apparatus, as it is necessary to drive odd-numbered scan electrodes and even-numbered scan electrodes independently, a Y scan driver is divided into an odd number Y scan driver for driving odd-numbered scan (Y) electrodes and an even number Y scan driver for driving even-numbered scan electrodes. Because of this, it is necessary to divide the 192 scan electrodes in one block into a group of the 96 odd-numbered electrodes and the other group of the 96 even-numbered electrodes and drive the two groups independently.

Therefore, in the case where eight 64-bit driver ICs are used, the output terminals of each IC and scan electrodes Y1 to Y384 are connected as shown in FIG. 5. To be specific, the 64 odd-numbered scan electrodes Y1 to Y127 are connected to the outputs of a first odd number IC 21-01, the 32 odd-numbered scan electrodes Y129 to 191 to the outputs of a second odd number IC 21-02, the 64 odd-numbered scan electrodes Y193 to Y319 to the outputs of a third odd number IC 21-03, and the 32 odd-numbered scan electrodes Y321 to 383 to the outputs of a fourth odd number IC 21-04, and similarly, the 64 even-numbered scan electrodes Y2 to Y128 are connected to the outputs of a first even number IC 21-El, the 32 even-numbered scan electrodes Y130 to Y192 to the outputs of a second even number IC 21-E2, the 64 even-numbered scan electrodes Y194 to Y320 to the outputs of a third even number IC 21-E3, and the 32 even-numbered scan electrodes Y322 to Y384 to the outputs of a fourth even number IC 21-E4. A signal OSD1 is a signal that commands the start of the first half of the address period, a signal ESD1 is a signal that commands the start of the second half of the address period and they are each inputted to the first odd number IC 21-01 and the first even number IC 21-E1 as the data input signal Din, respectively. Similarly, a signal OSD2 and a signal ESD2 are each inputted to the third odd number IC 21-03 and the third even number IC 21-E3 as the data input signal Din, respectively. The clock signal CLK is connected to each IC and the operation of each IC is performed with the clock cycles being synchronized with each other, but the connection of the clock signal CLK is not shown in FIG. 5 and is not shown also in the following figures.

When the signal OSD1 is inputted at the beginning of the first half of the address period, the first odd number IC 21-01 starts the shift operation in accordance with the cycle of the clock signal CLK and outputs a scan pulse sequentially to the 64 odd-numbered scan electrodes Y1 to Y127. Upon outputting a scan pulse to the electrode Y127, the first odd number IC 21-01 outputs a carry C. When the carry C is inputted as the data input signal Din, the second odd number IC 21-02 starts the shift operation and outputs a scan pulse sequentially to the 32 odd-numbered scan electrodes Y129 to Y191 at the clock cycle after that at which a scan pulse is output to the Y127. The second odd number IC 21-02 outputs more 32 scan pulses sequentially after outputting the 32 scan pulses, but these are not applied to the scan electrodes and, therefore, the operation of the PDP apparatus is not affected.

At the timing, after that, at which scan pulses are output to the Y1 to Y191, the signal OSD2 is inputted and the third odd number IC 21-03 starts the shift operation and outputs a scan pulse sequentially to the 64 odd-numbered scan electrodes Y193 to Y319. Then, after receiving the output of the carry C from the previous IC, the fourth odd number IC 21-04 also outputs a scan pulse sequentially to the 32 odd-numbered scan electrodes Y321 to Y383.

When the signal ESD1 is inputted at the beginning of the second half of the address period, the same operation is performed and a scan pulse is output sequentially to the even-numbered scan electrodes.

Conventionally, as described above, when a plurality of driver ICs were used, a cascade connection was employed so that the carry output from the previous driver IC was inputted to the data input Din of the next driver IC. Therefore, when some of the outputs of the driver IC were not used as shown in FIG. 5, wiring was made so that all of the outputs of the first and third odd number and even number driver ICs were used and some of the outputs of the second and fourth odd number and even number driver ICs were not used. In other words, the unused outputs of the driver ICs were distributed unevenly.

As described above, therefore, there may be a case where some outputs of the driver ICs are not used, in other words, some outputs of the driver ICs are excess depending on the number of electrodes, the number of output terminal groups for connecting electrodes and drivers, the number of electrodes per output terminal group, the number of driver IC outputs, whether an ALIS system or a normal system is used, etc.

SUMMARY OF THE INVENTION

Recently, the plasma display panel has become larger and larger and not only the number of electrodes but also the drive capacity and discharge current of each electrode are increased, resulting in a growing demand for driver ICs increased in performance. In particular, an ALIS system PDP apparatus described in Japanese Unexamined Patent Publication (Kokai) No. 9-160525 can realize a panel having display lines, the number of which is equal to that of a normal type, by using only half the number of scan electrodes and sustain electrodes, therefore, the manufacturing efficiency is high and an advantage that high-luminance displays are produced can be obtained, but as there may by a case where the drive capacity and discharge current of the scan electrode are approximately doubled compared to those of a normal type, therefore, driver ICs considerably increased in performance are required.

In particular, in the case of driver ICs to be used in the PDP apparatus, besides the drive performance of the individual driver circuits, the heat produced by the operation of the driver circuits is a big problem. For example, in the case of the Y scan driver 12, the part made up of the transistors ST1 and ST2 in each drive circuit turns on only one time during the address period. Therefore, as the drive capacity of the scan electrode is increased, the amount of heat produced in the drive circuit is increased accordingly but the influence of the produced heat is not so significant. In contrast to this, the part made up of the diodes D1 and D2 repeats turning on/off in each drive circuit 17 during the sustain period, therefore, the amount of heat produced in the entire IC will be very large even though the on-state resistance of the diode is smaller than that of the transistor. It is necessary to limit the number of sustain pulses in one frame in order to reduce the amount of heat to be produced and therefore the display luminance of the PDP apparatus cannot be increased. In other words, because of the limit of the drive performance of the driver IC, the performance of the PDP apparatus using the driver IC is also limited.

In the conventional case shown in FIG. 5, the amount of heat produced in the first and third odd number and even number driver ICs is large because all of the outputs are used, but the amount of heat produced in the second and fourth odd number and even number driver ICs is small because only some of the outputs are used. Therefore, the drive condition of the scan electrode is limited by the first and third odd number and even number driver ICs which are under the more severe conditions.

In the case of the address driver 11, there is the possibility that all of the driver circuits 16 in each driver IC repeat turning on/off and if the drive capacity and the discharge current of the address electrode are increased, the amount of heat to be produced in the address driver will be increased accordingly.

The first object of the present invention is to realize a PDP apparatus using a plasma display panel whose electrode has a large drive capacity by using already existing driver ICs.

The second object of the present invention is to improve the operating conditions when a PDP apparatus using a plasma display panel is realized by using a plurality of driver ICs.

In order to realize the first object described above, a plasma display apparatus (PDP apparatus) according to a first aspect of the present invention is characterized in that one electrode is driven by combining a plurality of drive signals output from a driver IC.

In other words, the PDP apparatus according to the first aspect of the present invention, comprising a plurality of electrodes and a drive circuit for driving the plurality of electrodes, is characterized in that the drive circuit comprises at least one driver IC having a plurality of outputs capable of outputting a plurality of drive signals independently and one of the electrodes is driven by combining the plurality of drive signals of the driver IC.

According to the aspect of the present invention, one electrode is driven by combining a plurality of drive signals (n drive signals) of the driver IC, therefore, the drive performance of one drive signal can be lowered by a factor of the number of the plurality of drive signals (n), and the amount of heat to be produced in the driver IC can also be reduced.

The electrode to be driven in this configuration is a scan electrode or a address electrode.

The cases where a plurality of drive signals are combined include a case where a plurality of drive signals output from the same driver IC are combined and a case where a plurality of drive signals output from different driver ICs are combined.

In the case where the drive signals output from the same driver IC are combined, it is necessary to ensure that the two drive signals are identical to each other. In contrast to this, in the case where the drive signals output from different driver ICs are combined, a conventional control can be employed and all that has to be done is to make the connection of the corresponding output terminals of the driver ICs.

However, when the drive signals output from different driver ICs are combined, there may be a case where there arises a slight difference in the rise or fall timing of each drive signal between driver ICs due to the errors caused during manufacture, and in such a case, there is the possibility that a transistor that operates as a high-voltage side switch of an IC and a transistor that operates as a low-voltage side switch of another IC are turned on simultaneously and a through-current flows as a result. Therefore, it is desirable to exactly adjust the timing of operation in the driver circuit in each IC. In the case where the drive signals output from the same driver IC are combined, there is almost no difference in timing in the same IC, therefore, there is little chance that such a problem might be brought about.

In general, a driver IC comprises a shift register for shifting input data sequentially in accordance with a clock, a latch circuit for latching and outputting the output of the shift register in accordance with a latch signal, and a plurality of drivers for outputting a drive signal in accordance with each output of the latch circuit. However, when such a driver IC is used in a scan driver in which the drive signals output from the same driver IC are combined, one part of the input data is inputted successively for a length of clocks corresponding to the number (n) of drive signals to be combined and a latch signal is issued at every clock corresponding to the number (n) of drive signals to be combined. When such a driver IC is used in an address driver in which the drive signals output from the same driver IC are combined, the same input data is inputted successively for a number of clocks corresponding to the number of drive signals to be combined and a latch signal is issued when all the input data is inputted to the output of the shift register.

The first aspect of the present invention can effectively be applied to an ALIS system PDP apparatus described in Japanese Unexamined Patent Publication (Kokai) No. 9-160525 because the drive capacity of the scan electrode thereof is larger than that of a normal PDP apparatus equal in size.

In order to realize the second object described above, a plasma display apparatus according to a second aspect of the present invention is characterized in that in a configuration in which a plurality of electrodes are driven by a plurality of identical driver ICs, when some of a plurality of outputs of the driver ICs are not connected to the electrodes and not used, the unused outputs are distributed to each driver IC as evenly as possible.

In other words, the plasma display apparatus according to the second aspect of the present invention, comprising a plurality of electrodes and a drive circuit for driving the plurality of electrodes, is characterized in that the drive circuit comprises a plurality of identical driver ICs having a plurality of outputs capable of outputting a plurality of drive signals independently, some of the plurality of outputs of the plurality of driver ICs are not used, and the number of the unused outputs in each of the plurality of driver ICs is substantially the same.

As described above, there may be a case where some outputs of the driver ICs are not used, in other words, some outputs of the driver ICs are in excess depending on the number of electrodes, the number of output terminal groups for connecting electrodes and drivers, the number of electrodes per output terminal group, the number of driver IC outputs, whether an ALIS system or a normal system is used, etc. In particular, as in the first aspect of the present invention, when one electrode is driven by combining a plurality of drive signals, it is likely that the outputs are in excess. According to the present invention, even when some of the driver IC outputs are not used, the unused outputs are distributed substantially evenly to each driver IC, therefore, the amount of heat produced in each driver IC is substantially the same and the operation conditions of the driver IC can be improved compared to a case where the produced heat is distributed unevenly.

The second aspect of the present invention can effectively be applied to a drive circuit for driving scan electrodes but can also be applied to address electrodes.

As described above, a driver IC comprises a shift register for shifting input data sequentially in accordance with a clock, a latch circuit for latching and outputting the output of the shift register in accordance with a latch signal, and a plurality of drivers for outputting a drive signal in accordance with each output of the latch circuit. In the present invention, a configuration, in which a carry signal output from a driver IC is received by the next driver IC, will produce wasted time required to shift the unused outputs in the previous IC. In order to avoid such wasted time, it is necessary to start the operation of a driver IC before the previous driver IC finishes outputting a scan pulse. Because of this, a counter is provided, which externally counts the number of shifts corresponding to the number of outputs connected to the electrodes in a shift register in each driver IC. When the output corresponding to the number of connected electrodes by the previous driver IC is finished, the counter issues a timing signal for controlling the next driver IC to start outputting. The same clock signal CLK is connected to each driver IC and counter so that the operation with synchronized clock cycle can be obtained.

As in the first aspect, the second aspect of the present invention can also be applied effectively to an ALIS system PDP apparatus.

The number of unused outputs of the driver ICs, which are not connected to the electrodes, is determined depending on the number of electrodes in a PDP apparatus, the number of output terminal groups for connecting electrodes and drivers, the number of electrodes per output terminal group, the number of driver IC outputs, whether an ALIS system or a normal system is used, etc., but either way, it is important to distribute the unused outputs to each driver IC as evenly as possible.

It is possible to simultaneously apply the first aspect and the second aspect of the present invention.

BRIEF DESCRIPTION OF THE DRAWINGS

The features and advantages of the invention will be more clearly understood from the following description taken in conjunction with the accompanying drawings, in which.

DESCRIPTION OF THE PREFERRED EMBODIMENTS

The plasma display apparatus (PDP apparatus) in the first embodiment of the present invention is an ALIS system PDP apparatus to which the present invention is applied.

Figure 6:
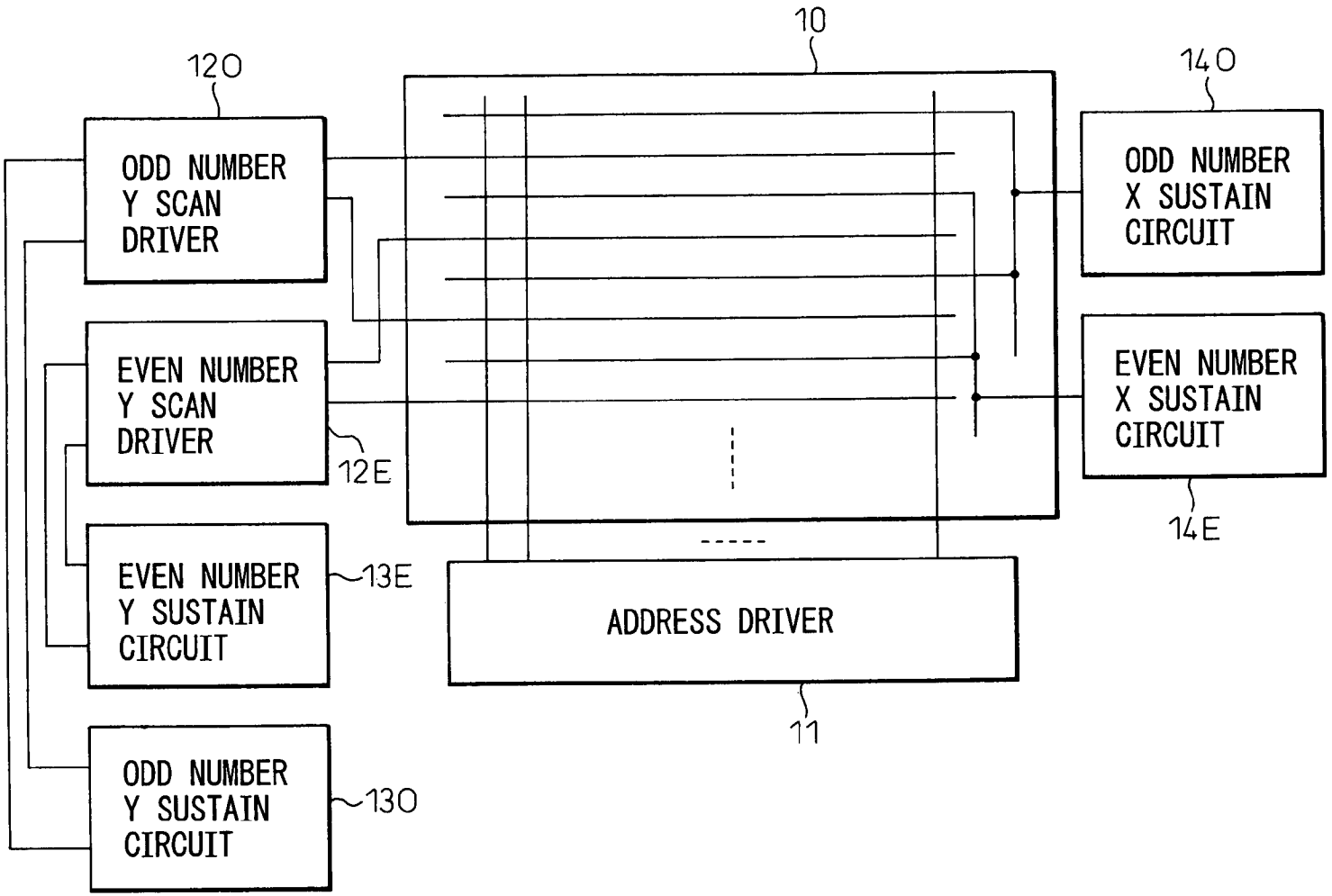
FIG. 6 is a diagram showing a general configuration of an ALIS system PDP apparatus.

FIG. 6 is a diagram showing the configuration of the plasma display apparatus (PDP apparatus) in the first embodiment. As an ALIS system PDP apparatus is described in detail in the above-mentioned Japanese Unexamined Patent Publication (Kokai) No. 9-160525, no detailed explanation is given here, but only the points directly relating to the present invention are explained briefly.

In the ALIS system plasma display panel 10, scan (Y) electrodes and sustain (X) electrodes are evenly spaced by turns and display lines are defined between respective opposite sides of the scan electrodes and the respective, adjacent sustain electrodes. The number of the sustain electrodes is one more than the number of the scan electrodes, that is, the number of the sustain electrodes is N+1 and the number of the scan electrodes is N. The ALIS system plasma display panel 10 in the first embodiment comprises 384 scan electrodes and 385 sustain electrodes, and 768 display lines are defined. Address electrodes are not particularly limited in number but it is assumed here, for example, that 1,024 address electrodes are provided and 1,024×768 display cells are defined.

In FIG. 6, an odd-numbered display line is defined between each scan electrode and the vertically adjacent sustain electrode in the upward direction and an even-numbered display line is defined between each scan electrode and the vertically adjacent sustain electrode in the downward direction. One frame is made up of an odd number field and an even number field, and the odd-numbered display lines are displayed in the odd number field and the even-numbered display lines are displayed in the even number field, which is called the interlaced display. Therefore, during the address period and the sustain period in the odd number field, a voltage for discharge is applied between each scan electrode and the vertically adjacent sustain electrode in the upward direction, both electrodes defining an odd-numbered display line, and a voltage for discharge is not applied between each scan electrode and the vertically adjacent sustain electrode in the downward direction, both electrodes defining an even-numbered display line. Similarly, during the address period and the sustain period in the even number filed, a voltage for discharge is applied between each scan electrode and the vertically adjacent sustain electrode in the downward direction, both electrodes defining an even-numbered display line, and a voltage for discharge is not applied between each scan electrode and the vertically adjacent sustain electrode in the upward direction, both electrodes defining an odd-numbered display line.

In order to make the application of such a voltage possible, the odd-numbered sustain (X) electrodes are commonly connected to an odd number X sustain circuit 140 and the even-numbered sustain (X) electrodes are commonly connected to an even number X sustain circuit 14E so that a voltage can be applied to the odd-numbered sustain electrodes and the even-numbered sustain electrode independently. Moreover, the odd-numbered scan (Y) electrodes are each connected to an odd number Y scan driver 120 and the even-numbered scan (Y) electrodes are each connected to an even number Y scan driver 12E. The odd number Y scan driver 120 and the even number Y scan driver 12E are supplied with a sustain pulse from an odd number Y sustain circuit 130 and an even number Y sustain circuit 13E, respectively.

Figure 7:
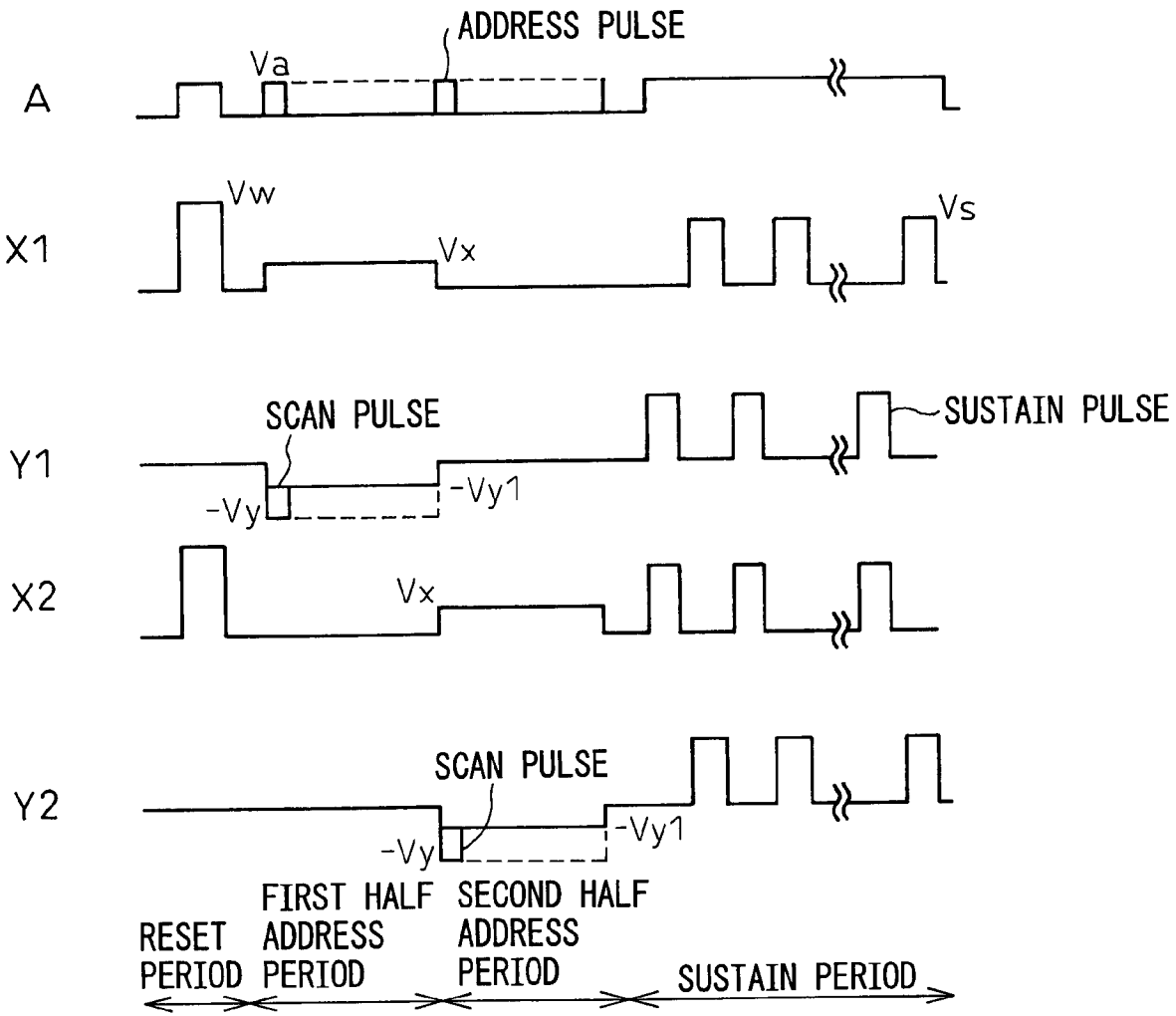
FIG. 7 is a diagram showing drive waveforms of an ALIS system.

FIG. 7 is a diagram showing drive waveforms in one subframe in the odd number field in the PDP apparatus in the first embodiment.

As shown in FIG. 7, during the reset period, the voltage Va is applied to all of the address electrodes, the voltage Vw is applied to the odd-numbered and even-numbered sustain (X) electrodes, and 0 V is applied to all of the scan (Y) electrodes. Due to this, a discharge is caused to occur between the sustain electrode and each of the scan electrodes and between the address electrode and each of the scan electrode in all of the display cells and all of the display cells are brought into a uniform state. The following address period is made up of a first half period during which cells to be lit are selected in the first, third, fifth, . . . , display lines of the odd-numbered display lines and a second half period during which cells to be lit are selected in the second, fourth, sixth, . . . , display lines of the odd-numbered display lines. During the first half period, in a state in which the voltage Vx is applied to the odd-numbered sustain electrodes, 0 V is applied to the even-numbered sustain electrodes and scan electrodes, and the voltage −Vyl is applied to the odd-numbered scan electrodes, a scan pulse having the voltage −Vy is applied sequentially to the odd-numbered scan electrodes and an address pulse having the voltage Va is applied to the address electrodes in the display cells to be lit in synchronization with the application of a scan pulse. An address discharge is caused to occur between the odd-numbered scan electrodes to which a scan pulse has been applied and the address electrodes to which an address pulse has been applied and wall charges are formed in the vicinity of the odd-numbered sustain electrodes to which he voltage Vx is applied and in the vicinity of the odd-numbered scan electrodes. In this manner, the cells to be lit are selected in the first, third, fifth, . . . , display lines of the odd-number display lines.

During the second half period, in a state in which the voltage Vx is applied to the even-numbered sustain electrodes, 0 V is applied to the odd-numbered sustain electrodes and scan electrodes, and the voltage −Vyl is applied to the even-numbered scan electrodes, a scan pulse having the voltage −Vy is applied sequentially to the even-numbered scan electrodes and an address pulse having the voltage Va is applied to the address electrodes in the display cells to be lit in synchronization with the application of a scan pulse. An address discharge is caused to occur between the even-numbered scan electrodes to which a scan pulse has been applied and the address electrodes to which an address pulse has been applied, and wall charges are formed in the vicinity of the even-numbered sustain electrodes to which the voltage Vx is applied and in the vicinity of the odd-numbered scan electrodes. In this manner, the cells to be lit are selected in the second, fourth, sixth, . . . , display lines of the odd-number display lines.

During the sustain period, in a state in which the voltage Va is applied to the address electrodes, sustain pulses in phase are applied to the odd-numbered scan electrodes and the even-numbered sustain electrodes, and sustain pulses with the opposite phase are applied to the even-numbered scan electrodes and the odd-numbered sustain electrodes. As a result, the sustain voltage Vs is, applied alternately between the odd-numbered sustain electrodes and the odd-numbered scan electrodes and between the even-numbered sustain electrodes and the even-numbered scan electrodes, therefore, a sustain discharge is caused to occur and light is emitted in the display cells selected during the first half period and the second half period of the address period.

In the even number field, displays of the even-numbered display lines are produced by exchanging the voltage waveforms between the odd-numbered sustain electrodes and the even-numbered sustain electrodes.

As the configuration described above is the same as that of the conventional ALIS system PDP apparatus described in Patent Document 1, no explanation is given here. By the way, the ALIS system has various examples of modifications and the present invention can also be applied to those modifications.

Figure 4:
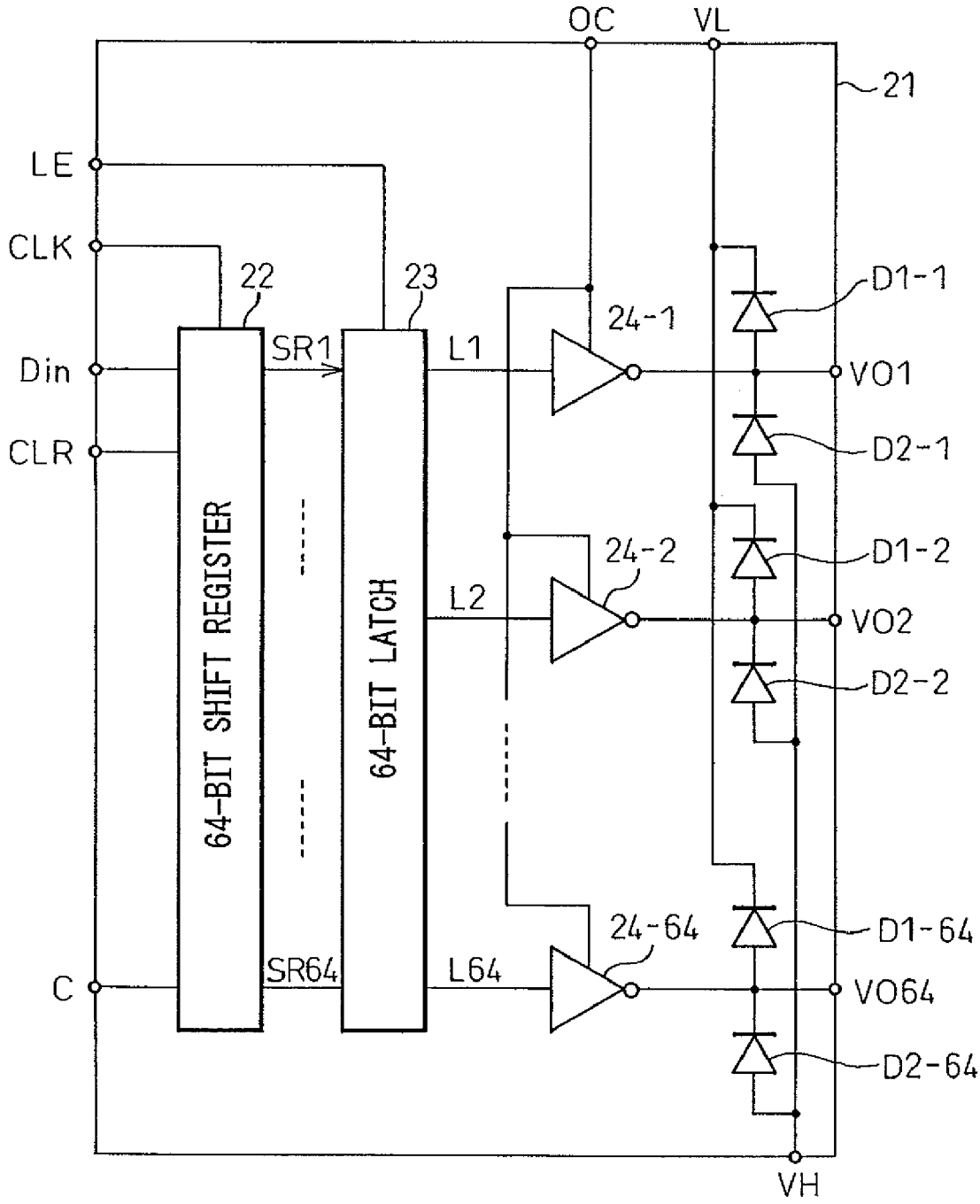
FIG. 4 is a diagram showing an example of a configuration of a driver IC.

In the PDP apparatus in the first embodiment, the address driver 11, the odd number Y scan driver 120 and the even number Y scan driver 12E are different in configuration from the conventional PDP apparatus. The configurations of these components in the first embodiment are described below. It is assumed that the 64-bit driver IC shown in FIG. 4 is used in the first embodiment. The heat that will be produced should be considered on the basis of all of the ICs rather than on the basis of each IC and what should be focused on is the heat produced in all of the driver ICs 21.

Figure 8:
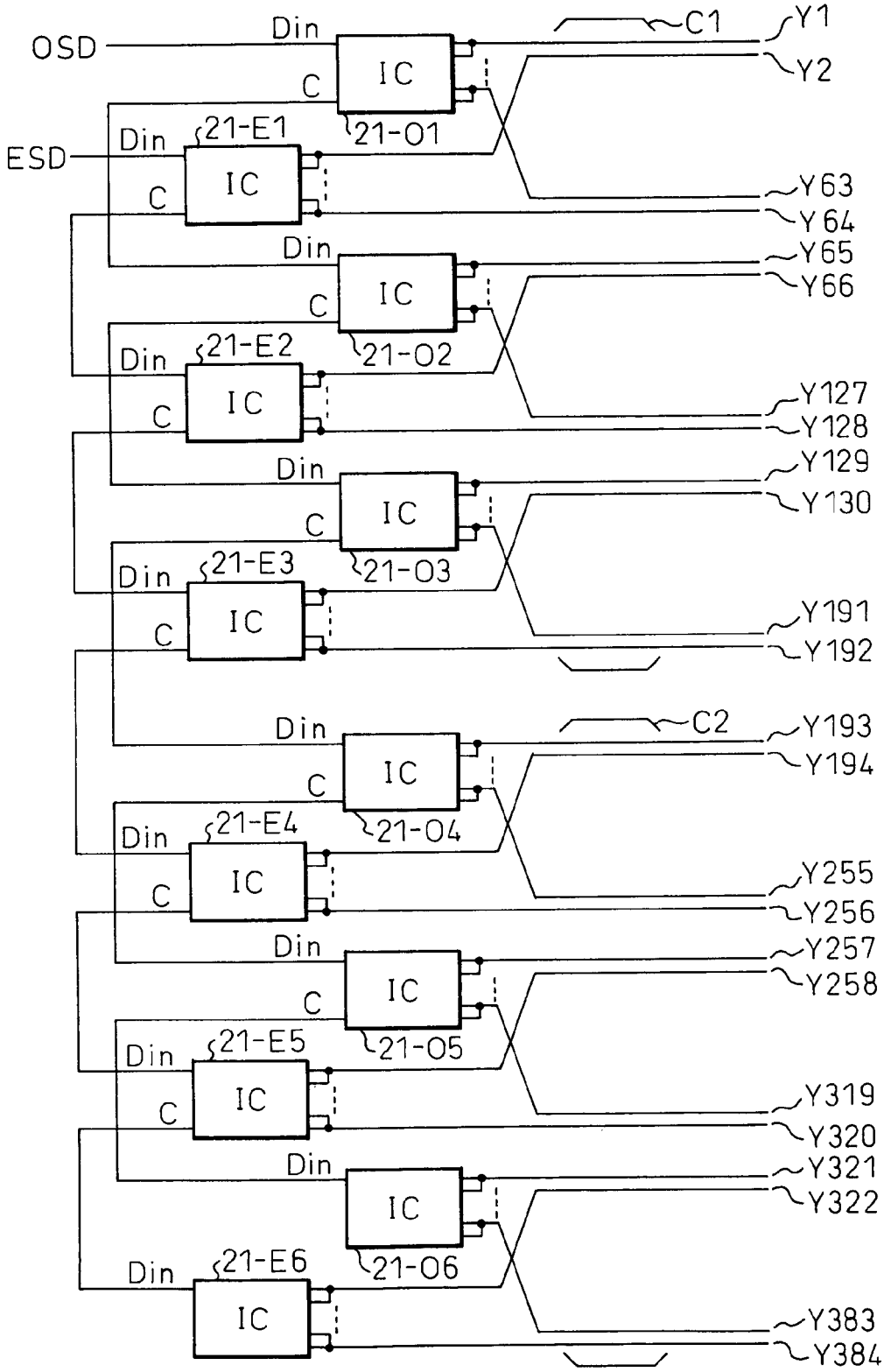
FIG. 8 is a diagram showing wiring between scan (Y) electrodes and driver IC outputs in the first embodiment of the present invention.

FIG. 8 is a diagram showing wiring between the scan (Y) electrodes and the IC outputs in the first embodiment. As described above, the drive capacity of the scan electrode of the ALIS system plasma display panel (PDP) is large and there may be a case where only one output of the driver IC 21 is insufficient in drive performance for driving one scan electrode.

In order to solve the above-mentioned problem, two neighboring outputs of one driver IC 21 are combined to drive one scan electrode in the first embodiment. If necessary, it is also possible to combine three or more outputs to drive one scan electrode. Here, 32 scan electrodes are driven using one 64-bit driver IC 21. As described above, there are 384 scan electrodes, therefore, 12 driver ICs 21 are used. Moreover, as the PDP apparatus employs the ALIS system, it is necessary to drive the odd-numbered scan electrodes and the even-numbered scan electrodes independently and, therefore, the scan driver is divided into the odd number scan driver 120 for driving odd-numbered scan (Y) electrodes and the even number scan driver 12E for driving even-numbered scan (Y) electrodes. The odd number scan driver 120 and the even number scan driver 12E are each made up of six driver ICs 21, respectively. Moreover, when the scan drivers and the scan electrodes of the PDP 10 are connected by thermal compression bonding using an anisotropic conductive film, the 384 electrodes are divided into two blocks and are connected through two groups of output terminals, because of the requirements of the thermal compression bonding apparatus and the connection performance.

As shown in FIG. 8, the 192 scan (Y) electrodes, that is, the first to hundred and ninety-second scan (Y) electrodes, are connected to a first scan driver circuit via a group of output terminals C1, and the remaining 192 scan (Y) electrodes, that is, the hundred and ninety-third to three hundred eighty-fourth scan (Y) electrodes, are connected to a second scan driver circuit via a group of output terminals C2. The first scan driver circuit has six driver ICs 21-01 to 21-03 and 21-E1 to 21-E3, and the outputs of the first odd number driver IC 21-01 are connected, with two neighboring outputs being combined, to the odd-numbered electrodes Y1, Y3, . . . , Y63 of the 64 scan (Y) electrodes, that is, the first to sixty-fourth scan (Y) electrodes and the first even number driver IC 21-E1 is connected, with two neighboring outputs being combined, to the even-numbered electrodes Y2, Y4, Y64 of the 64 scan (Y) electrodes, that is, the first to sixty-fourth scan (Y) electrodes. Similarly, the second odd number driver IC 21-02 and the third odd number driver IC 21-03 are connected to the odd-numbered electrodes Y65, Y67, . . . , Y191 of the 128 scan (Y) electrodes, that is, the sixty-fifth to hundred and ninety-second scan (Y) electrodes, and the second even number driver IC 21-E2 and the third even number driver IC 21-E3 are connected to the even-numbered electrodes Y66, Y68, . . . , Y192 of the 128 scan (Y) electrodes, that is, the sixty-fifth to hundred and ninety-second scan (Y) electrodes.

Moreover, the second scan driver circuit has six driver ICs 21-04 to 21-06 and 21-E4 to 21-E6, and the fourth odd number driver IC 21-04 to the sixth odd number driver IC 21-06 are connected, with two neighboring outputs being combined, to the odd-numbered electrodes Y193, Y195, . . . , Y383 of the 192 scan (Y) electrodes, that is, the hundred and ninety-third to three hundred and eighty-fourth scan (Y) electrodes, and the fourth even number driver IC 21-E4 to the sixth even number driver IC 21-E6 are connected, with two neighboring outputs being combined, to the even-numbered electrodes Y194, Y196, . . . , Y384 of the 192 scan (Y) electrodes, that is, the hundred and ninety-third to three hundred and eighty-fourth scan (Y) electrodes.

As shown in FIG. 8, a carry output C of the first odd number driver IC 21-01 is connected to the input data Din of the second odd number driver IC 21-02, the carry output C of the second odd number driver IC 21-02 is connected to the input data Din of the third odd number driver IC 21-03, and thus the carry output C of an odd number driver IC is connected to the input data Din of the next odd number driver IC. Similarly, the carry output C of an even number driver IC is connected to the input data Din of the next even number driver IC.

Figure 9:
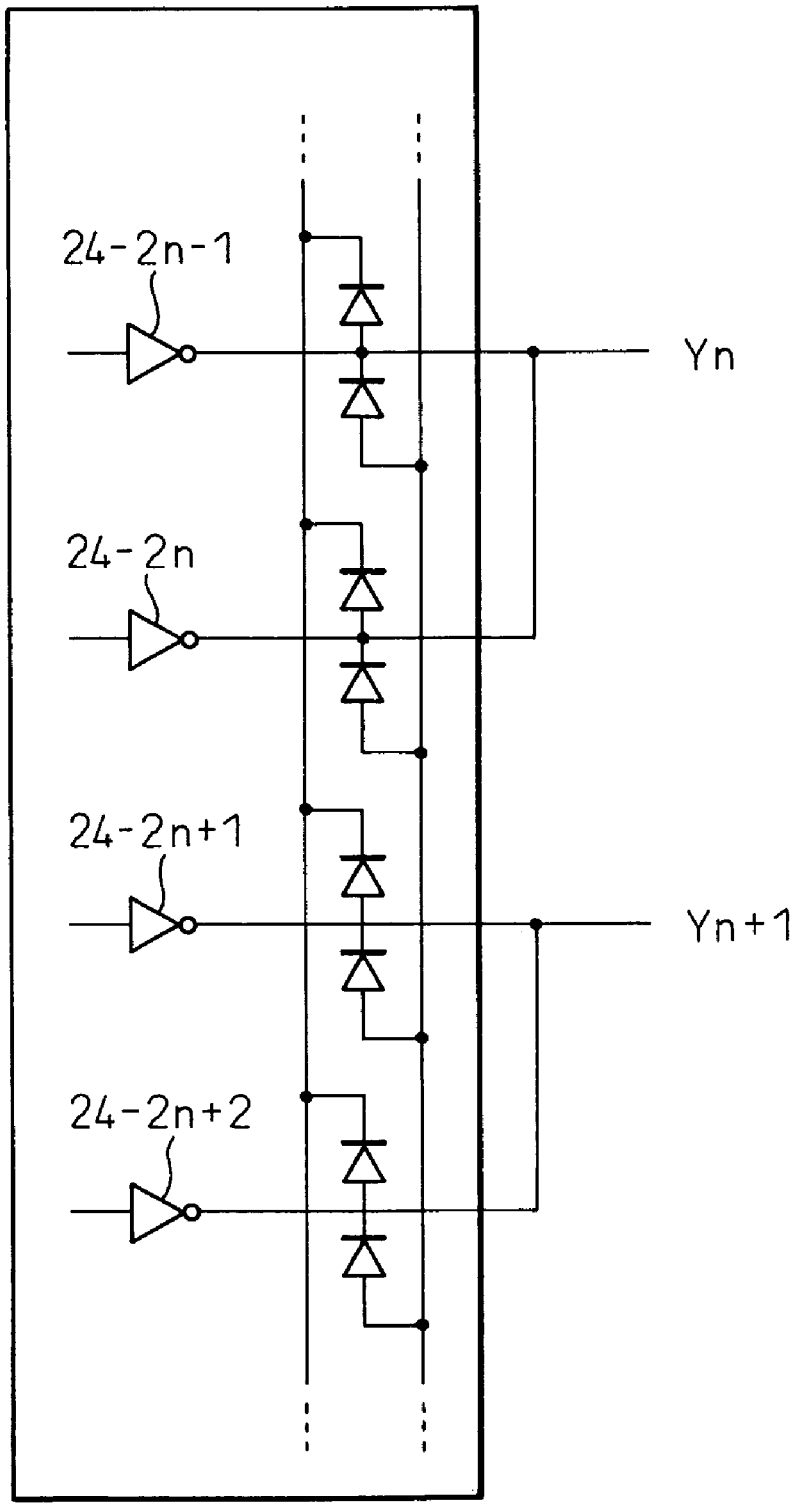
FIG. 9 is a diagram showing a connection state at outputs in the first embodiment.

FIG. 9 is a diagram showing a detailed connection state at the outputs of a driver IC. As shown schematically, in a state in which the output of a driver 24-(2*n*−1) and the output of a driver 24-2*n* of the driver IC are connected, the connection point is connected to the n-th scan (Y) electrode Yn, and in a state in which the outputs of drivers 24-(2*n*+1) and 24-(2*n*+2) are connected, the connection point is connected to the (n+1) th scan (Y) electrode Y n+1.

Figure 10:
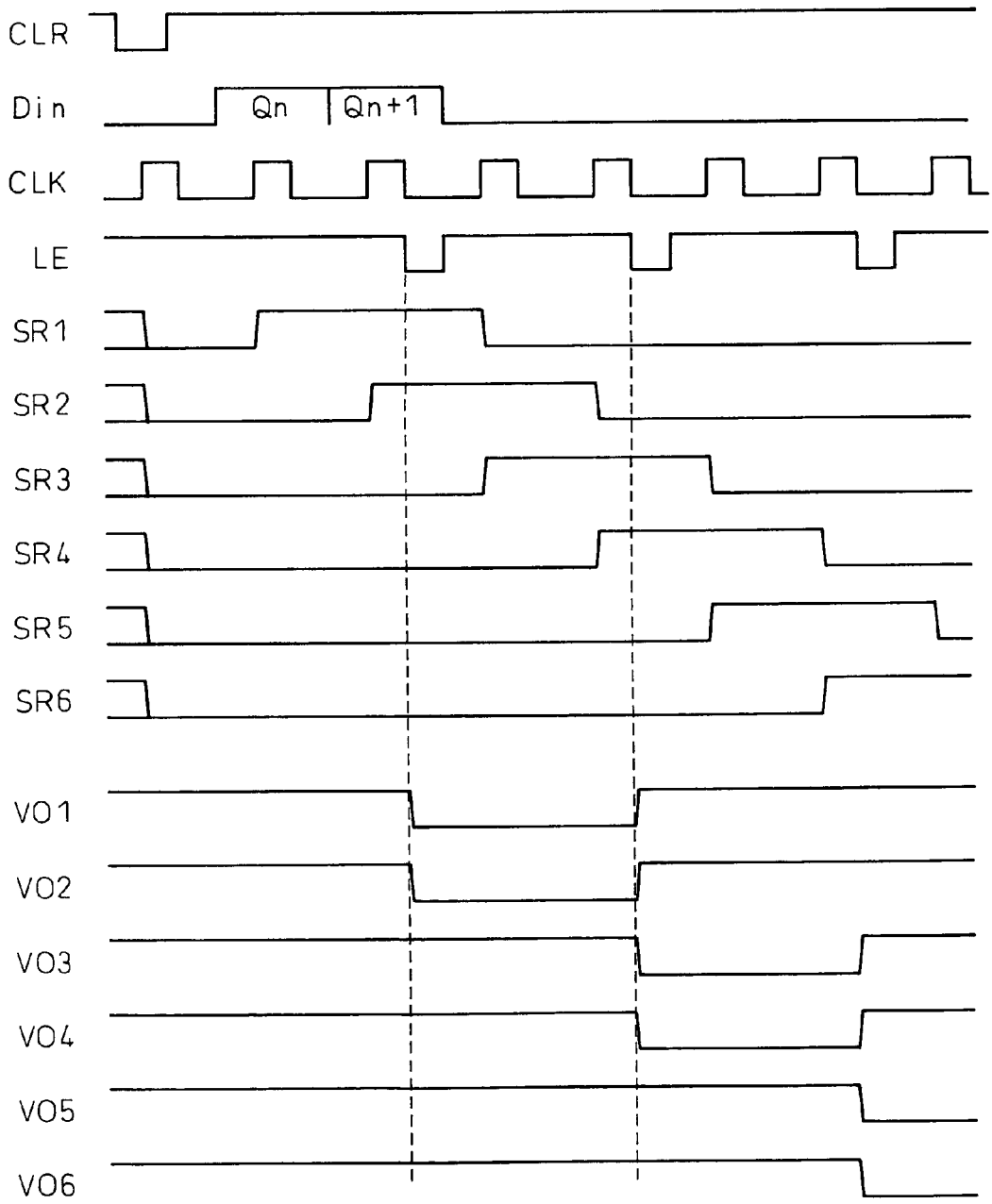
FIG. 10 is a diagram showing drive waveforms of a scan driver in the first embodiment.

FIG. 10 is a diagram showing the drive waveforms of the driver IC 21 in the first embodiment. In the first embodiment, two neighboring outputs of the driver IC are combined to drive one scan (Y) electrode and, therefore, the two neighboring outputs of the driver IC need to be the same and the positions of the two outputs need to be shifted sequentially by the amount corresponding to two outputs. Therefore, the period of a clock CLK signal to be supplied to the driver IC is set to half of the address period divided by 384, that is, half of the period of the clock in the case of the conventional ALIS system. Then, after all of the values held by the shift register 22 are reset to 0 ("L") by inputting a clear CLR signal, the input data Din is set to 1 ("H") during the period of time corresponding to two clock CLK signals. Due to this, the state of the shift register 22 in which the outputs of two successive stages are 1 is shifted sequentially. Then, a latch signal LE is issued at every two clocks when the output of the shift register 22, which is "1", is shifted to the next even-numbered stage. Due to this, the latch circuit 23 outputs a state in which two neighboring outputs, that is an odd-numbered output and the next even-numbered output, are 1 and other outputs are 0, and shifts the position at which the output is 1 by two outputs each time the latch signal LE is issued. In this manner, a drive signal, in which a state in which two neighboring odd-numbered and even-numbered outputs are 1 and other outputs are 0 is shifted sequentially by two outputs, can be obtained from the driver IC 21.

Figure 11:
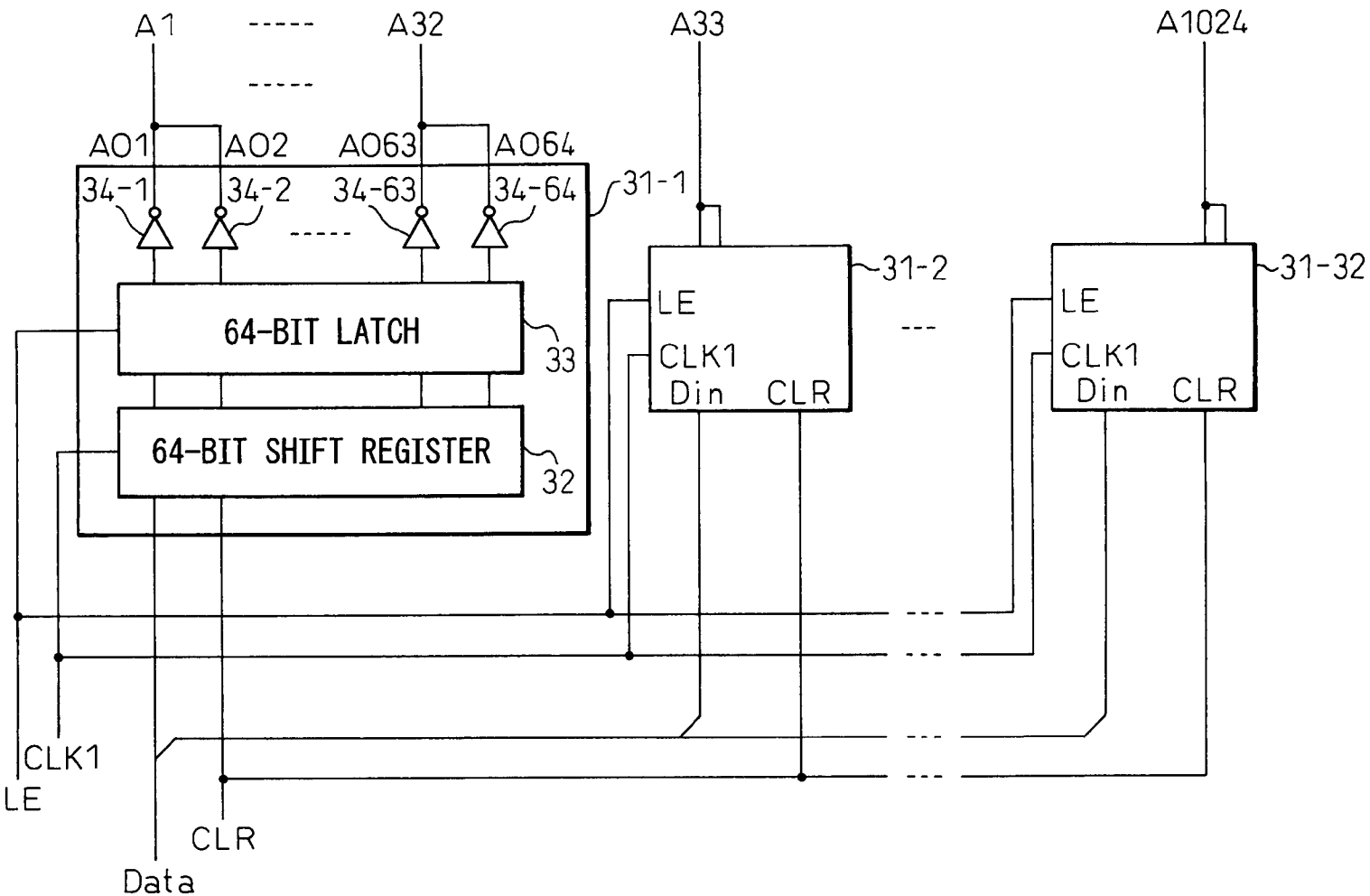
FIG. 11 is a diagram showing a configuration of an address driver in the first embodiment.

In the first embodiment, one address electrode is driven by two neighboring outputs in the address driver 11 as well as in the Y scan driver. FIG. 11 is a diagram showing the configuration of the address driver 11 in the first embodiment. The address driver 11 also is made up of the driver ICs and it is assumed that 64-bit driver ICs are used here. The driver IC of the address driver 11 has a configuration similar to that of the driver IC of the scan driver, having a 64-bit shift register 32, a 64-bit latch 33, and 64 output drivers 34-1 to 34-64, but not the diodes D1 and D2.

As described above, there are 1,024 address electrodes and each driver IC drives 32 address electrodes, therefore, the address driver 11 is made up of 32 driver ICs 31-1 to 31-32. Because it is necessary for the address driver 11 to prepare data for one display line during the period of one scan pulse, 32-bit display data is supplied to each of the 32 driver ICs IC31-1 to 31-32, respectively, and the 32 driver ICs 31-1 to 31-32 are driven in parallel.

Figure 12:
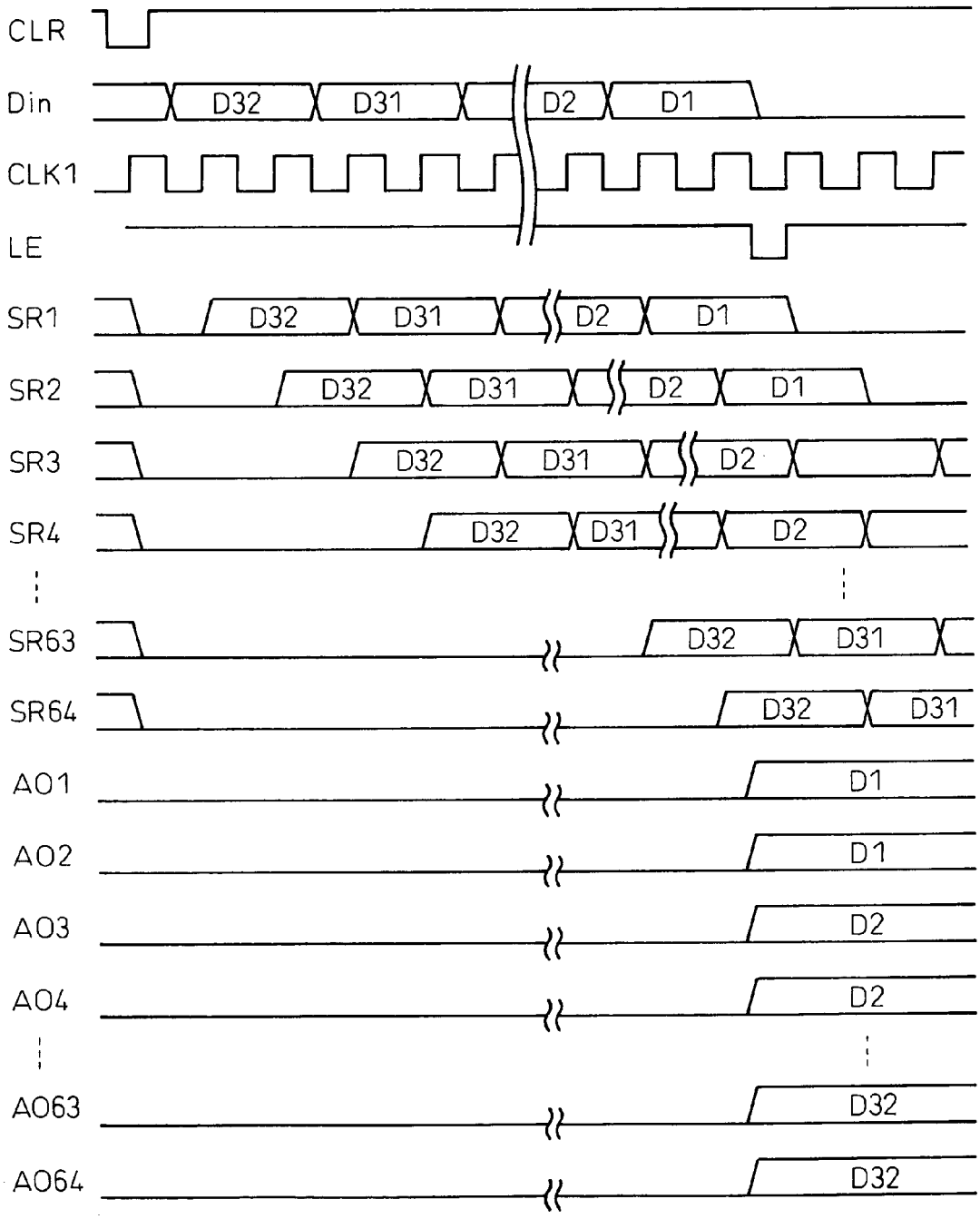
FIG. 12 is a diagram showing drive waveforms of the address driver in the first embodiment.

FIG. 12 is a diagram showing the drive waveforms of the address driver in the first embodiment. The operation differs from that of the conventional address driver in that the input data is changed at every two clock CLK1 signals. Due to this, a state in which two neighboring bits are the same data is shifted sequentially and when the last two bits of the 64 bits are reached, that is, when a state in which 32 items of input data in units of two bits are ready, is established, the latch signal LE is inputted and an output is produced. Due to this, one address electrode can be driven by two neighboring outputs.

In the first embodiment, in both the scan driver and in the address driver, one electrode is driven by two outputs of the driver IC, but it is also possible to drive one electrode by two outputs only in one of the drivers and to drive one electrode by one output in the other driver, the drive performance and the produced heat being taken into account.

Next, the second embodiment of the present invention is explained. The second embodiment of the present invention is an embodiment in which the present invention is applied to a PDP apparatus having the conventional configuration explained in FIG. 1 and FIG. 2. The PDP 10 in the second embodiment has 768 scan (Y) electrodes, 768 sustain (X) electrodes and 1,024 address electrodes, and the Y scan driver 12 is made up of the driver ICs shown in FIG. 4. It is assumed that the address driver 11 is the same as before or has a configuration similar to that explained in FIG. 11 but no detailed explanation is given here.

Figure 13:
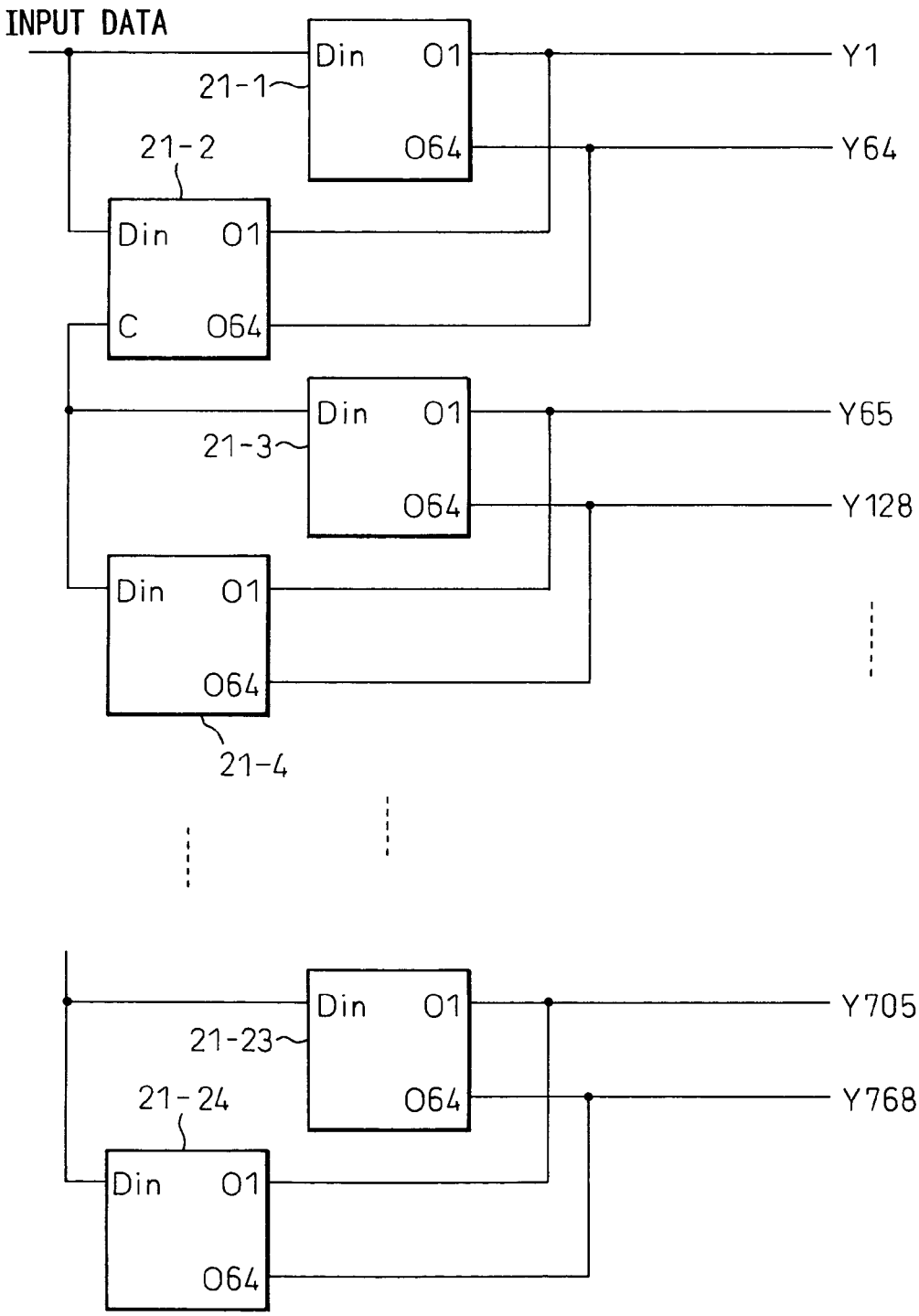
FIG. 13 is a diagram showing wiring between scan (Y) electrodes and driver IC outputs in a second embodiment of the present invention.

FIG. 13 is a diagram for explaining wiring between the scan (Y) electrodes and the driver IC outputs in the second embodiment. In the second embodiment, the outputs of two of the driver ICs are combined to drive one scan (Y) electrode. Therefore, when the 768 scan (Y) electrodes are driven using the 64-bit driver ICs, it is necessary to use 24 driver ICs 21-1 to 21-24. As shown in FIG. 13, the respective first to sixty-fourth outputs of the first driver IC 21-1 and the respective first to sixty-fourth outputs of the second driver IC 21-2 are combined and connected to the respective first to sixty-fourth scan (Y) electrodes. Similarly, the respective first to sixty-fourth outputs of the third driver IC 21-3 and the respective first to sixty-fourth outputs of the fourth driver IC 21-4 are combined and connected to the respective sixty-fifth to hundred and twenty-eighth scan (Y) electrodes, and thus the respective outputs of an odd-numbered driver IC and the respective outputs of the next even-numbered driver IC are combined and connected to the respective 64 scan (Y) electrodes, and so on. To be more exact, the m-th output of the (N-l)th driver IC and the m-th output of the N-th driver IC are combined and connected to the {32(N−2)+m}th scan (Y) electrode (N is an even number and N≦24).

Moreover, in the second embodiment, input data that stays 1 ("H") during one clock is inputted to the Din terminals of the first and second driver ICs 21-1 and 21-2, the carry C of the first driver IC 21-1 or the second driver IC 21-2 is inputted to the Din terminals of the third and fourth driver ICs 21-3 and 21-4, and thus the carry of the (N−1)th and N-th driver ICs is inputted to the Din terminals of the (N+1)th and (N+2)th driver ICs (N is even number and N≦24).

In other words, the configuration in the second embodiment is one in which twelve driver ICs are further provided in parallel and the outputs of the corresponding driver ICs are connected in the conventional configuration in which the 768 scan electrodes are driven by the twelve 64-bit driver ICs. Therefore, the drive waveforms of the driver IC are the same as before.

In the arrangement of the driver ICs in the second embodiment shown in FIG. 13, all of the driver ICs are provided on the same surface of the substrate, therefore, the wire lengths are different and there is the possibility of a shift in rise and fall between drive signals of the two driver ICs, the outputs of which are combined. If such a shift occurs, the switching transistor on the high-potential side of one of the driver ICs and the switching transistor on the low-potential side of the other driver IC are turned on simultaneously and there is the possibility of a through-current even though it flows for a brief time.

Figure 14:
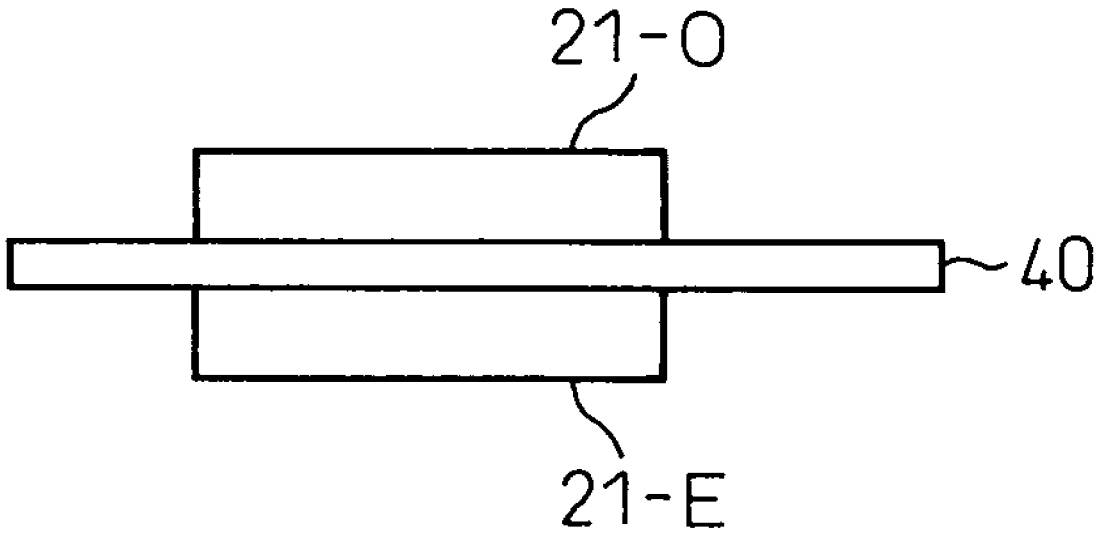
FIG. 14 is a diagram showing an example of a modification of the second embodiment.

In order to make such a shift as small as possible, it is also possible to provide the two driver ICs, the outputs of which are combined, separately on the surface and the undersurface of a substrate 40, for example, as shown in FIG. 14. In this case, if the odd-numbered driver ICs 21-O (O is an odd number from 1 to 23 inclusive) are provided on the surface of the substrate, the even-numbered driver ICs 21-E (E is an even number from 2 to 24 inclusive) are provided on the undersurface of the substrate, through holes are provided in the substrate 40 and corresponding outputs are connected, the wire length from each IC can be substantially identical to each other and the above-mentioned shift can be reduced. In this case, however, it is necessary to arrange the outputs of the odd-numbered driver ICs and the outputs of the even-numbered driver ICs so as to be symmetric between the surface and the undersurface.

In the first and second embodiment, one Y electrode is driven by two outputs of the driver ICs, but in a PDP apparatus in the third embodiment of the present invention, which is explained below, one Y electrode is driven by one output of the driver IC. The PDP apparatus in the third embodiment employs the ALIS system and has a general configuration similar to that of the PDP apparatus in the first embodiment shown in FIG. 6. In the PDP apparatus in the third embodiment, the odd number Y scan driver 120, the even number Y scan driver 12E and the address driver 11 are realized using the driver ICs shown in FIG. 4, but the wiring between the outputs of the driver ICs and the scan (Y) electrodes differs from the conventional wiring. Other parts have the same configurations as before. The configuration of the Y scan driver in the third embodiment is explained below.

Figure 15:
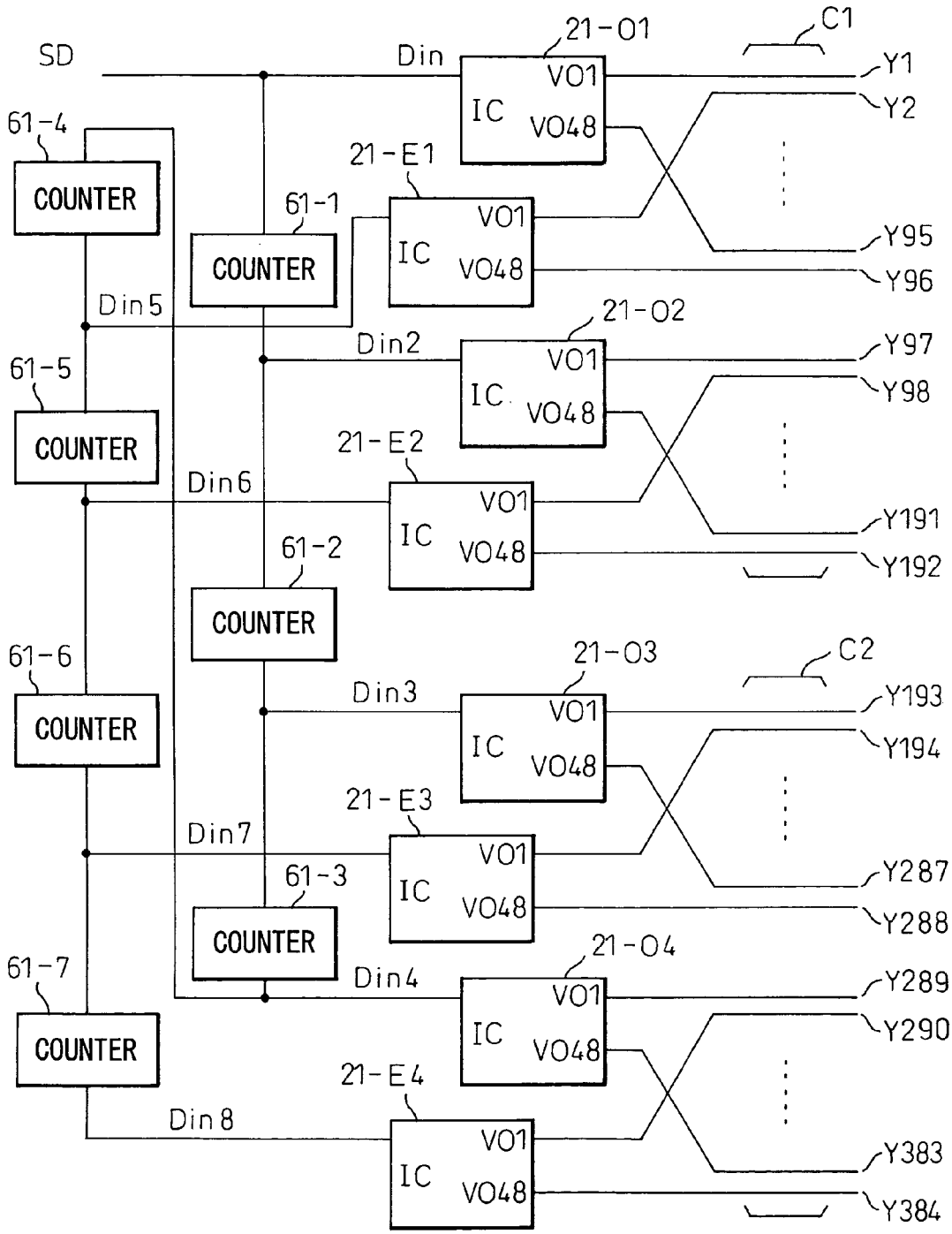
FIG. 15 is a diagram showing wiring between scan (Y) electrodes and driver IC outputs in a third embodiment of the present invention.
Figure 16:
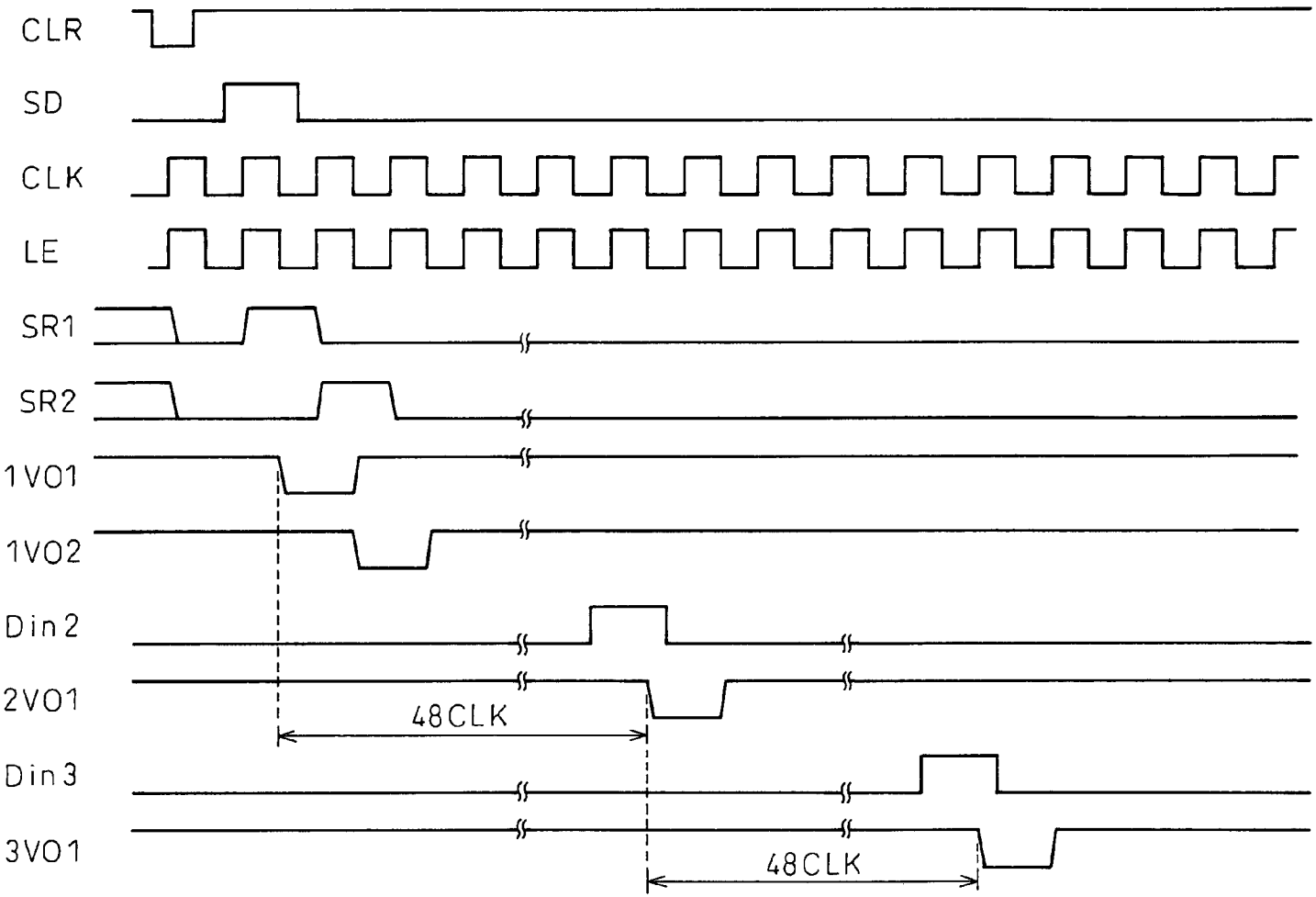
FIG. 16 is a diagram showing drive waveforms of a scan driver in the third embodiment.

FIG. 15 is a diagram showing the wiring between the scan (Y) electrodes and the IC outputs in the third embodiment, and FIG. 16 is a diagram showing the drive waveforms of the scan driver. In the third embodiment, as in the conventional case shown in FIG. 5, the 384 scan electrodes are divided into two blocks and connected to the eight 64-bit driver ICs through the two groups of output terminals C1 and C2, but a first output VO 1 to the forty-eighth output VO 48 of the eight driver ICs are used and the forty-ninth to sixty-fourth outputs are not used (not connected). In other words, the third embodiment differs from the conventional case in that one quarter of the outputs of each driver IC is not used.

To be specific, as shown in FIG. 15, the odd-numbered scan electrodes are connected as follows: the 48 scan electrodes Y 1 to Y 95 are connected to the outputs of the first odd number IC 21-01, the 48 scan electrode Y 97 to Y 191 to the outputs of the second odd number IC21-02, the 48 scan electrodes Y 193 to Y 287 to the outputs of the third odd number IC 21-03, and the 48 scan electrodes Y 289 to Y 383 to the outputs of the fourth odd number IC 21-04. The even-numbered scan electrodes are connected as follows: the 48 scan electrodes Y 2 to Y 96 are connected to the outputs of the first even number IC 21-E1, the 48 scan electrodes Y 98 to Y 192 to the outputs of the second even number IC 21-E2, the 48 scan electrodes Y 194 to Y 288 to the outputs of the third even number IC 21-E3, and the 48 scan electrode Y 290 to Y 384 to the outputs of the fourth number IC 21-E4.

The signal SD commands the start of the address period and is inputted to a counter 61-1 as well as to the first odd number IC 21-01 as the data input signal Din. The same clock signal CLK is inputted to each driver IC and to each counter and the clock cycle is synchronized. The counter 61-1 issues a timing signal to start the scanning from the forty-ninth electrode of the odd-numbered electrodes after the signal SD commands the start and 48 clock cycles are counted. The timing signal is inputted to a counter 61-2 as well as to the second odd number IC 21-02 as the data input signal Din 2. The counter 61-2 and counters 61-3 to 61-7 start the count when the previous counter issues the timing signal and issues the timing signal after 48 clock cycles are counted.

As shown in FIG. 16, if the signal SD is inputted at the beginning of the address period, the first odd number driver IC 21-01 starts a shift operation and outputs a scan pulse sequentially to outputs 1V01 to 1V048 to be connected to the 48 odd-numbered scan electrodes Y1 to Y95. Concurrently with this, the counter 61-1 keeps on counting. When 48 clock cycles are counted after the start signal SD is inputted, the first odd number driver IC21-01 outputs a scan pulse to Y95 and at the same time, the counter 61-1 outputs the timing signal Din2. When the timing signal Din2 is inputted, the second odd number driver IC21-02 starts a shift operation and outputs a scan pulse sequentially to outputs 2V01 to 2V048 to be connected to the 48 odd-numbered scan electrodes Y97 to Y191.

Figure 5:
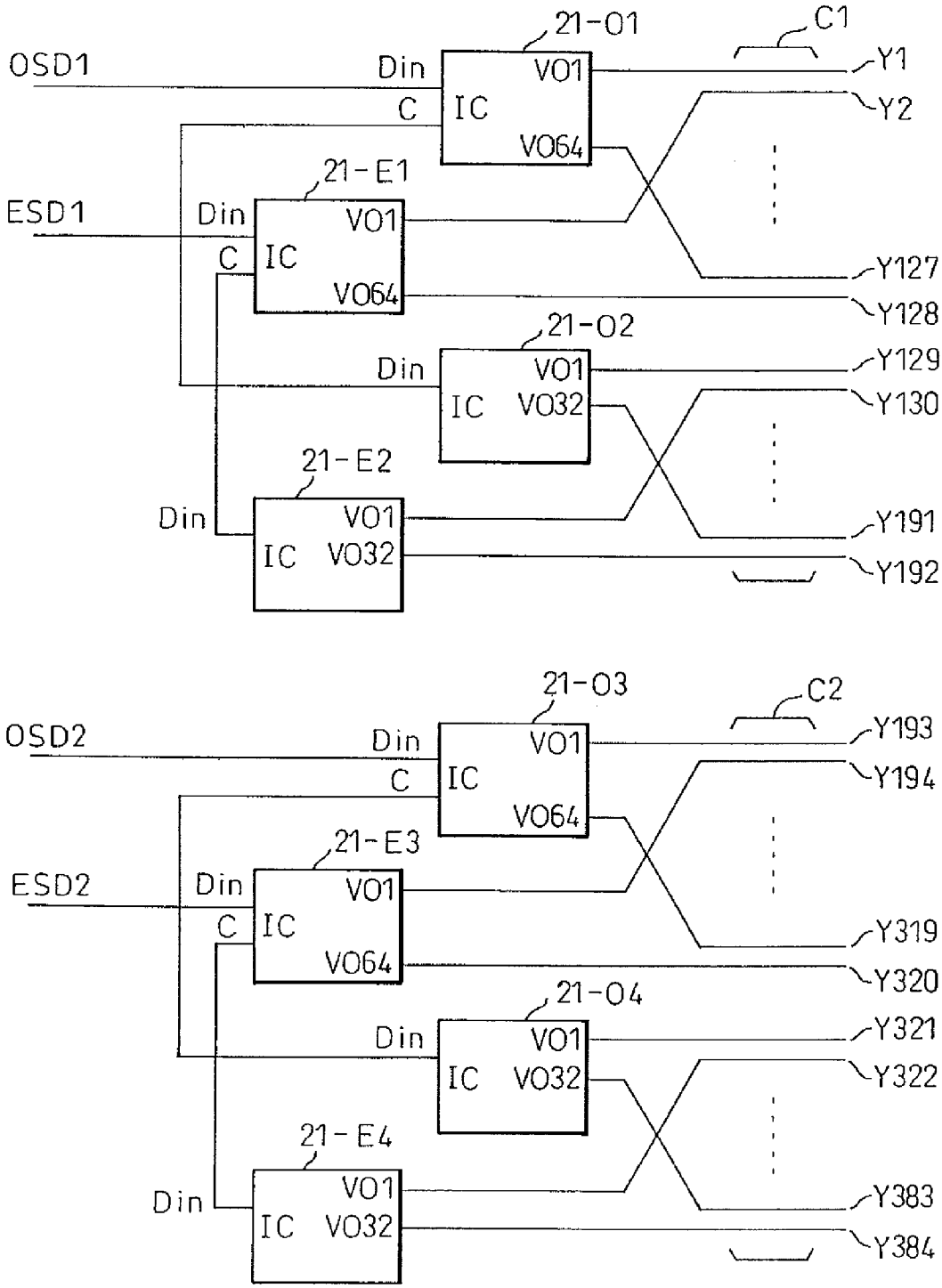
FIG. 5 is a diagram showing wiring between scan (Y) electrodes and driver IC outputs in a conventional case.

In the same manner, the counters 61-2 to 61-7 issue the timing signals Din3 to Din8 sequentially and in accordance with this, the driver ICs 21-03, 21-04, 21-E1, 21-E2, 21-E3, and 21-E4 each output 48 scan pulses sequentially. In this embodiment, a scan pulse is output successively between the first half period and the second half period of the address period, but it is also possible to use a signal that commands the start of the second half period of the address period as in the conventional case as shown in FIG. 5.

As described above, in the third embodiment, some of the outputs of the driver ICs are not connected to the electrodes and not used, but these unused outputs are distributed evenly to each driver IC, therefore, the amount of heat produced in each driver IC is almost the same. Because of this, it is possible to improve the operating condition of the driver ICs compared to the case where the unused outputs of the driver ICs are distributed unevenly.

Figure 1:
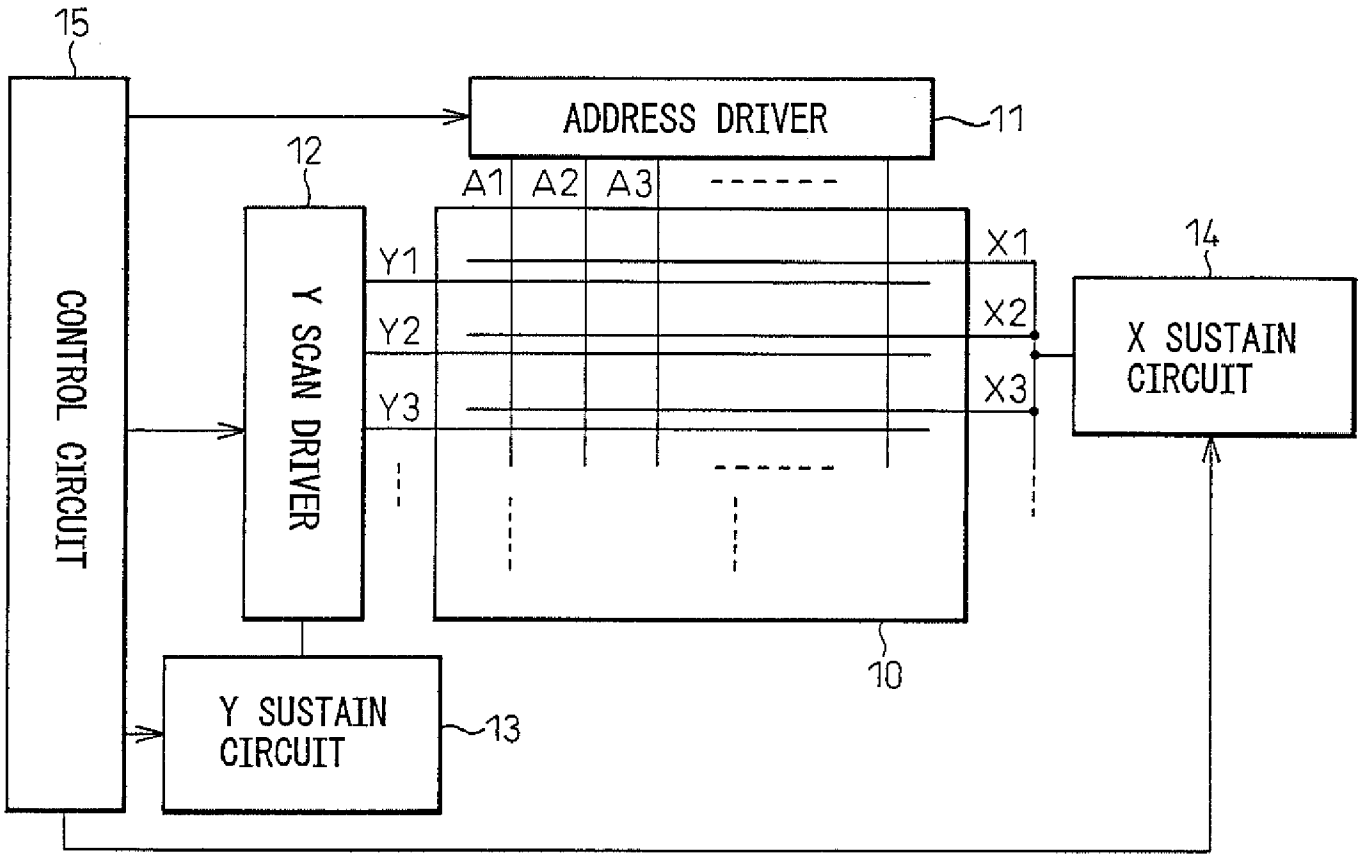
FIG. 1 is a diagram showing a fundamental configuration of a plasma display (PDP) apparatus.
Figure 2:
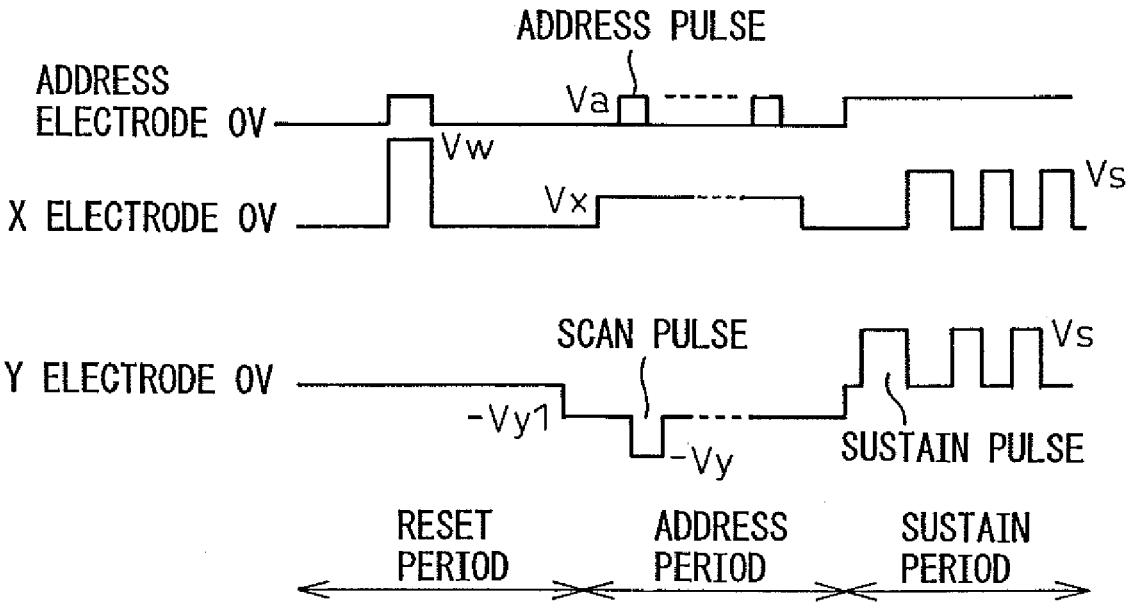
FIG. 2 is a diagram showing drive waveforms of a PDP apparatus.
Figure 3:
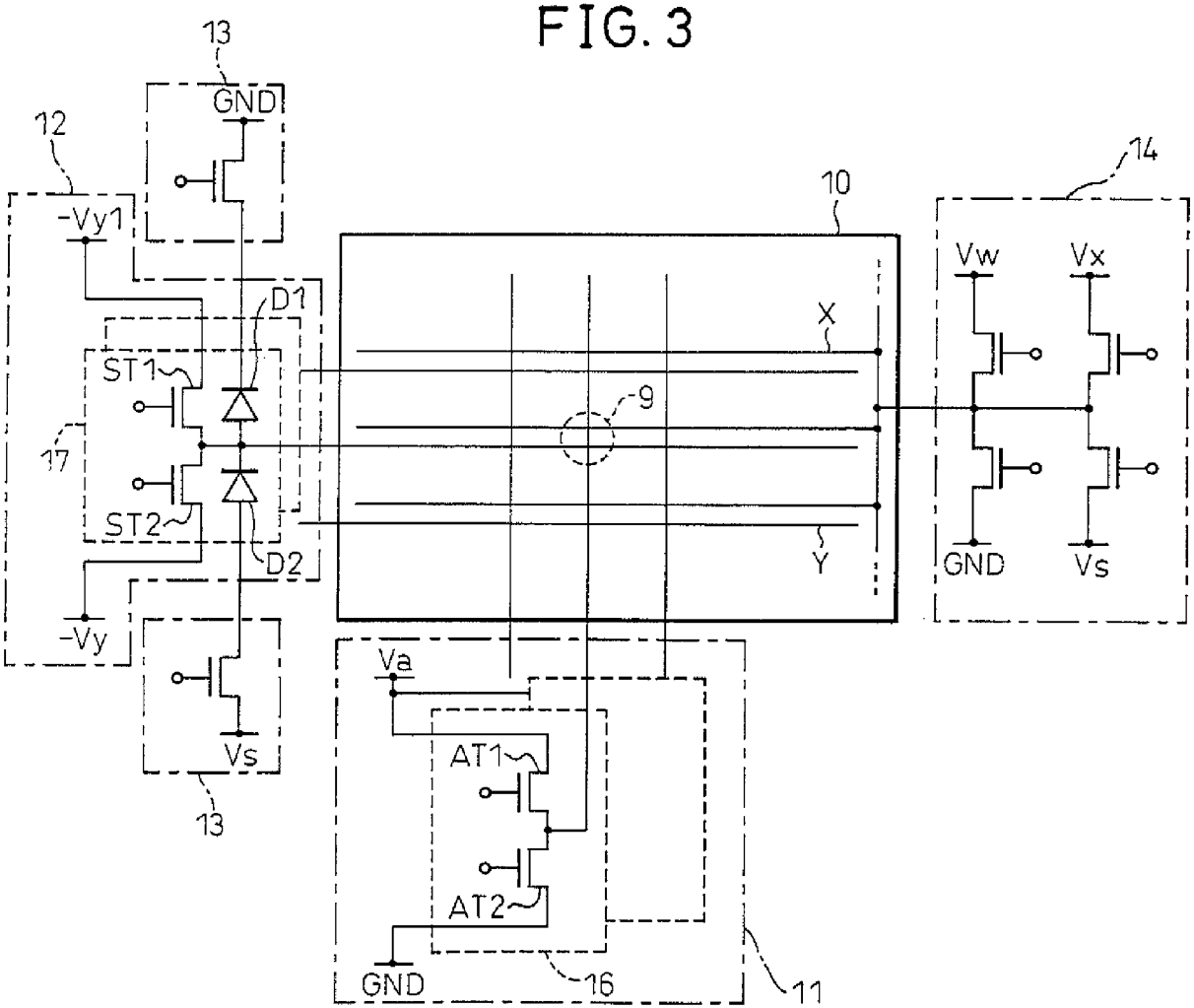
FIG. 3 is a diagram showing an example of a configuration of a conventional drive circuit.
Figure 17:
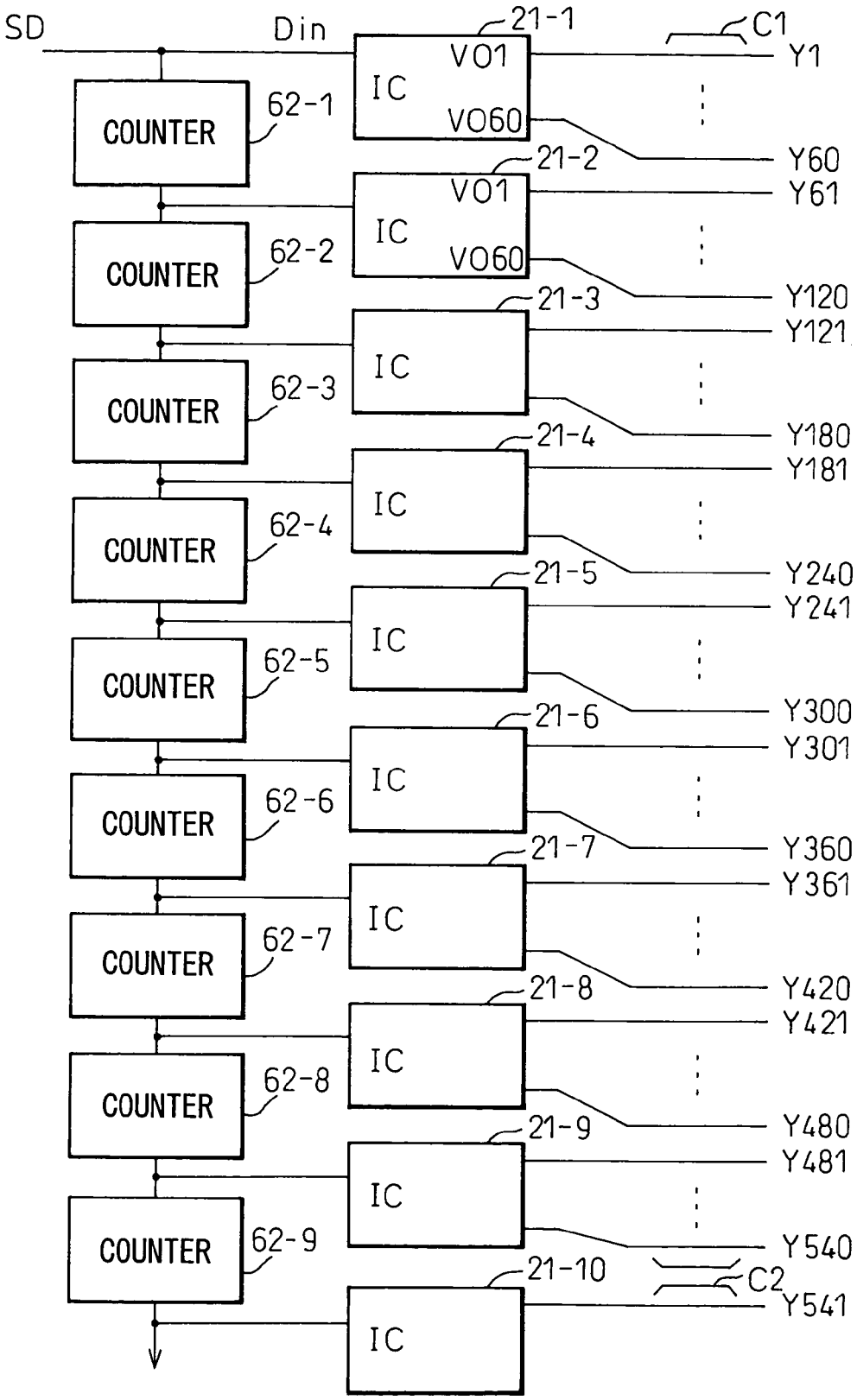
FIG. 17 is a diagram showing wiring between scan (Y) electrodes and driver IC outputs in a fourth embodiment of the present invention.

FIG. 17 is a diagram showing wiring between scan (Y) electrodes and IC outputs in the fourth embodiment of the present invention. In the fourth embodiment, a conventional plasma display panel (PDP) 10, not employing the ALIS system shown in FIG. 1, is used. The PDP 10 has 1,080 scan (Y) electrodes and 1,080 sustain (X) electrodes, respectively, and 1,080 display lines are defined. The address electrodes are not particularly limited in number.

In the fourth embodiment also, the 1,080 scan electrodes are divided into two blocks each having the 540 scan electrodes and connected through two groups of output terminals C1 and C2 because of the condition of the thermal compression bonding apparatus and the connection performance. The scan driver uses eighteen 64-bit driver ICs shown in FIG. 4 and drives the 540 scan electrodes connected to the group of output terminals C1 using nine driver ICs 21-1 to 21-9 and drives the remaining 540 scan electrodes connected to the other group of output terminals C2 using other nine driver ICs. In FIG. 17, only the connection between the 540 electrodes connected to the group of output terminals C1 and the outputs of the nine driver ICs 21-1 to 21-9 is shown, but the connection of the electrodes connected to the other group of output terminals C2 is the same. As shown schematically, only outputs V01 to V060 of each driver IC are used and four outputs V061 to V064 are not used.

The first driver IC21-l starts to output a scan pulse sequentially in accordance with a signal SD that commands the start of the address period. A counter 62-1 counts 60 clock cycles in accordance with the signal SD and outputs a timing signal. The second driver IC21-2 starts to output a scan pulse sequentially in accordance with the timing signal. In the same manner, counters 62-2 to 62-8 each count 60 clock cycles and output the timing signal sequentially, and the driver ICs 21-3 to 21-9 each start to output a scan pulse sequentially in accordance with the timing signal. The operations of the driver ICs connected to the scan electrodes connected to the group of output terminals C2 are the same and a counter that receives the timing signal output from the counter 62-8 and performs the same operation and counters that follow and perform the same operations sequentially are provided.

Figure 18:
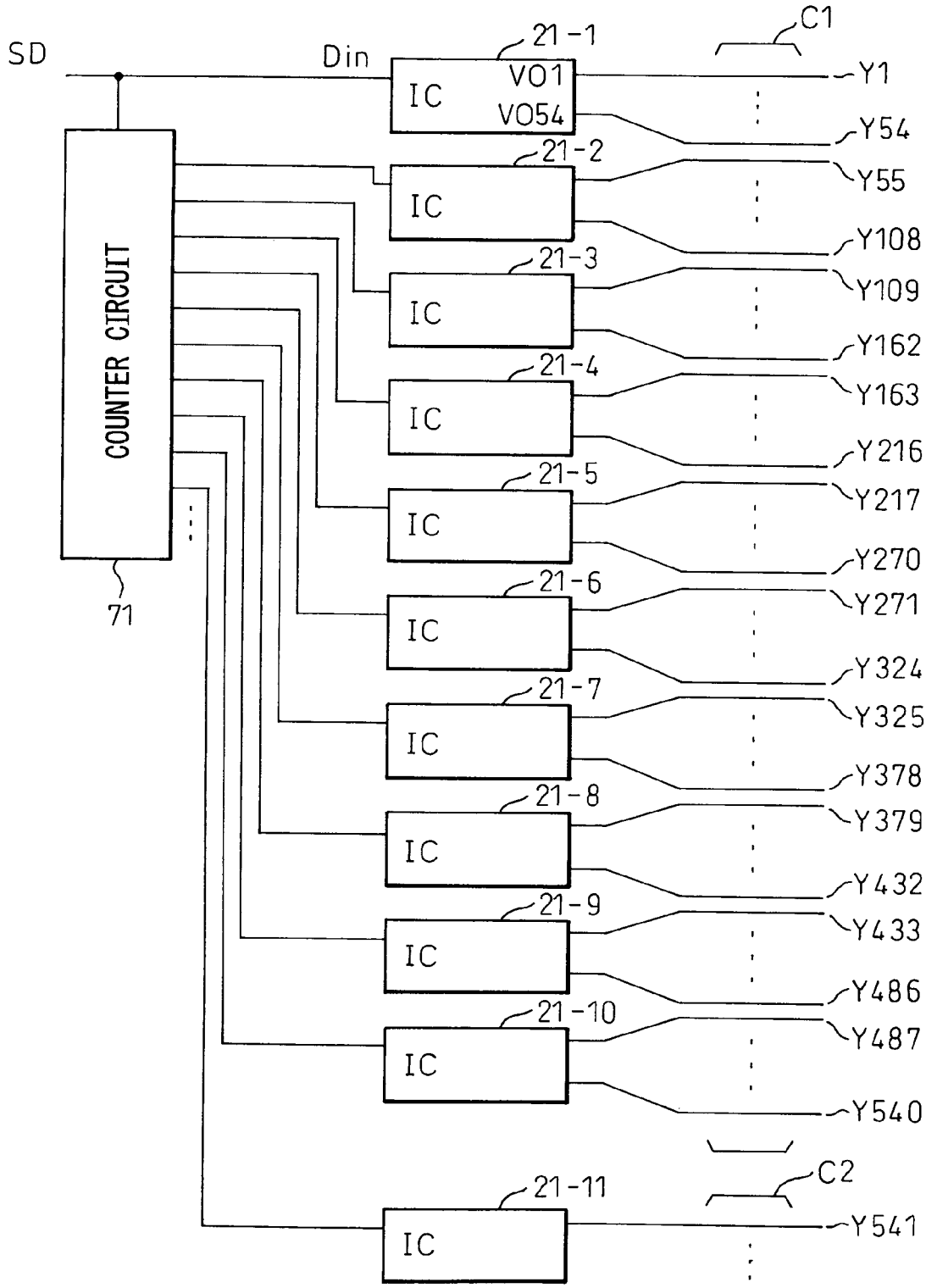
FIG. 18 is a diagram showing wiring between scan (Y) electrodes and driver IC outputs in an example of a modification of the fourth embodiment.

In the case of the scan driver in the second embodiment, the unused outputs of the driver ICs are distributed evenly to each driver IC, but as the 60 outputs out of the 64-bit outputs are used, the amount of heat produced in each driver IC is still large and there may be a case where the operating condition is limited. One of the solutions to such a problem is a modification, in which the number of driver ICs to be used is increased and the number of outputs to be used in each driver IC is decreased. FIG. 18 is a diagram showing wiring between scan (Y) electrodes and driver IC outputs in a modification of the fourth embodiment.

As shown in FIG. 18, in this modification, twenty 64-bit driver ICs are used and, in each driver IC, 54 outputs are used and 10 outputs are not used. Due to this, the effect that the amount of heat produced in each driver IC is reduced by approximately 10% can be expected. In a case of an attempt to further reduce the amount of heat produced in each driver IC, it is recommended to increase the number of the driver ICs to be used and use, for example, 24 driver ICs.

In the fourth embodiment, 18 driver ICs are used and 17 counters are used to control the generation of the shift signal of the second and following driver ICs. However, the 17 counters are each used to count up to the same number, therefore, the function can be made common. Consequently, in the modification shown in FIG. 18, one counter circuit 71 is used. The counter circuit 71 internally comprises a counter that repeatedly counts 54 clock cycles, a shift register that performs a shift operation in accordance with the output of the counter, and a gate circuit that issues a timing signal when the output of the shift register changes.

As described above, in the fourth embodiment also, some of the outputs of the driver ICs are not connected and not used, but these unused outputs are distributed evenly to each driver IC, therefore, the amount of heat produced in each driver IC is almost the same and it is possible to improve the operating condition of the driver ICs compared to the case where the unused outputs are distributed unevenly.

The first to fourth embodiments are described as above, but there can be various examples of modifications. For example, it is also possible to simultaneously apply the first aspect and the second aspect of the present invention.

In the first and second embodiments, all of the outputs of all of the driver ICs are used, but there may be a case where some of the driver IC outputs are not used because of the factors such as the number of electrodes in each group of output terminals, the number of driver IC outputs, and the number of outputs to be connected. For example, as in the first embodiment, when the number of scan (Y) electrodes is 384 and two blocks each having 192 scan electrodes are connected through two groups of outputs terminals, 64-bit driver ICs are used, and the outputs of two different driver ICs are combined in an ALIS system PDP apparatus, 64 odd-numbered scan (Y) electrodes are driven by two odd-numbered electrode driver ICs and 64 even-numbered scan (Y) electrodes are driven by two even-numbered electrode driver ICs and, as a result, the minimum unit of scan (Y) electrodes to be driven is 128. Therefore, when 192 scan electrodes are connected to one group of output terminals, twice the minimum amount, that is, 192 scan electrodes, are driven using a total of eight driver ICs and 128 outputs of the driver ICs are not used.

In this case, one possible method is as follows: the 128 scan electrodes, that is, the first to hundred and twenty-eighth electrodes, are driven by the first two odd-numbered electrode driver ICs and the first two even-numbered electrode driver ICs, and the other 64 scan electrodes, that is, the hundred and twenty-ninth to hundred ninety-second electrodes are driven by the last two odd-numbered electrode driver ICs and the last two even-numbered electrode driver ICs. This is also applicable to the electrodes to be connected to the other group of output terminals. In this case, the thirty-third to sixty-fourth outputs of the last two odd-numbered electrode driver ICs and the last two even-numbered electrode driver ICs are not used. As a result, one of possible control sequences is as follows: if an addressing in the first half period and an addressing in the second half period are performed as shown in FIG. 7, a counter for counting clocks is provided and when the outputting of the thirty-second output of the last two odd-numbered electrode driver ICs or the last two even-numbered electrode driver ICs is completed, that is, when 96 clocks are counted, the operations of the driver ICs for driving the scan electrodes connected to the other group of output terminals are made to start.

In this configuration, however, the amount of heat produce in the four driver ICs for driving the 128 scan electrodes, that is, the first to hundred twenty-eighth scan electrodes, is large and the amount of heat produced in the four driver ICs for driving the 64 scan electrode, that is, the hundred twenty-ninth to hundred ninety-second scan electrodes, is relatively small. The circuit is, as a whole, limited in operation by the IC that produces the largest amount of heat, therefore, such a situation in which the amount of produced heat is distributed unevenly is not acceptable. It is, therefore, desirable that the unused outputs are distributed evenly to each driver IC as in the third and fourth embodiments. The fifth embodiment is an embodiment that meets the above-mentioned demand.

Figure 19:
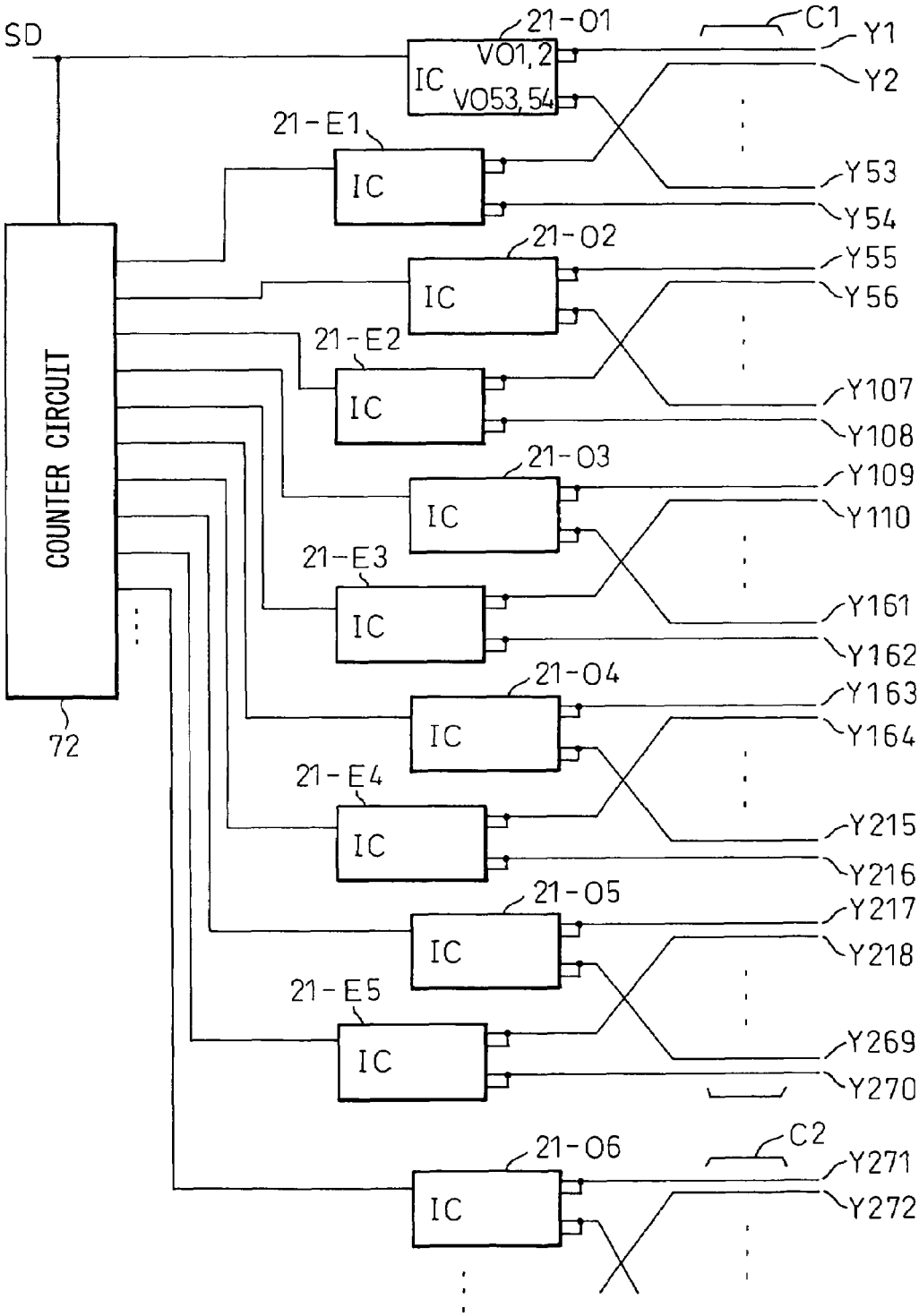
FIG. 19 is a diagram showing wiring between scan (Y) electrodes and driver IC outputs in a fifth embodiment of the present invention.

FIG. 19 is a diagram showing wiring between scan (Y) electrodes and driver IC outputs in the fifth embodiment of the present invention. In the fifth embodiment, the ALIS system plasma display panel (PDP) 10 shown in FIG. 6 is used. The PDP 10 has 540 scan (Y) electrodes and 541 sustain (X) electrodes and 1,080 display lines are defined. Address electrodes are not particularly limited in number.

In the fifth embodiment also, the 540 scan electrodes are divided into two blocks and connected through two groups of output terminals C1 and C2. A scan driver uses twenty 64-bit driver ICs shown in FIG. 4 and two neighboring outputs of each driver IC are combined and connected to each scan (Y) electrode. As shown schematically, only outputs V01 to V054 of the outputs of each driver IC are used and 10 outputs V055 to V064 are not used. As each scan electrode is driven by two outputs of the driver IC, the drive performance will be approximately doubled compared to the case where each scan electrode is driven by one output. Moreover, the amount of heat produced in each driver IC is approximately halved compared to the case where all of the outputs drive different scan electrodes. As the unused outputs are distributed evenly to each driver IC, the amount of heat produced in each driver IC is almost the same.

A counter 72 is a counter circuit configured in the same manner as the example of the modification shown in FIG. 18. The connection between the driver IC outputs and the scan electrodes is the same as that in the first embodiment shown in FIG. 9. Other parts are the same as those in the first and second embodiments, therefore, no explanation will be given here.

Figure 20:
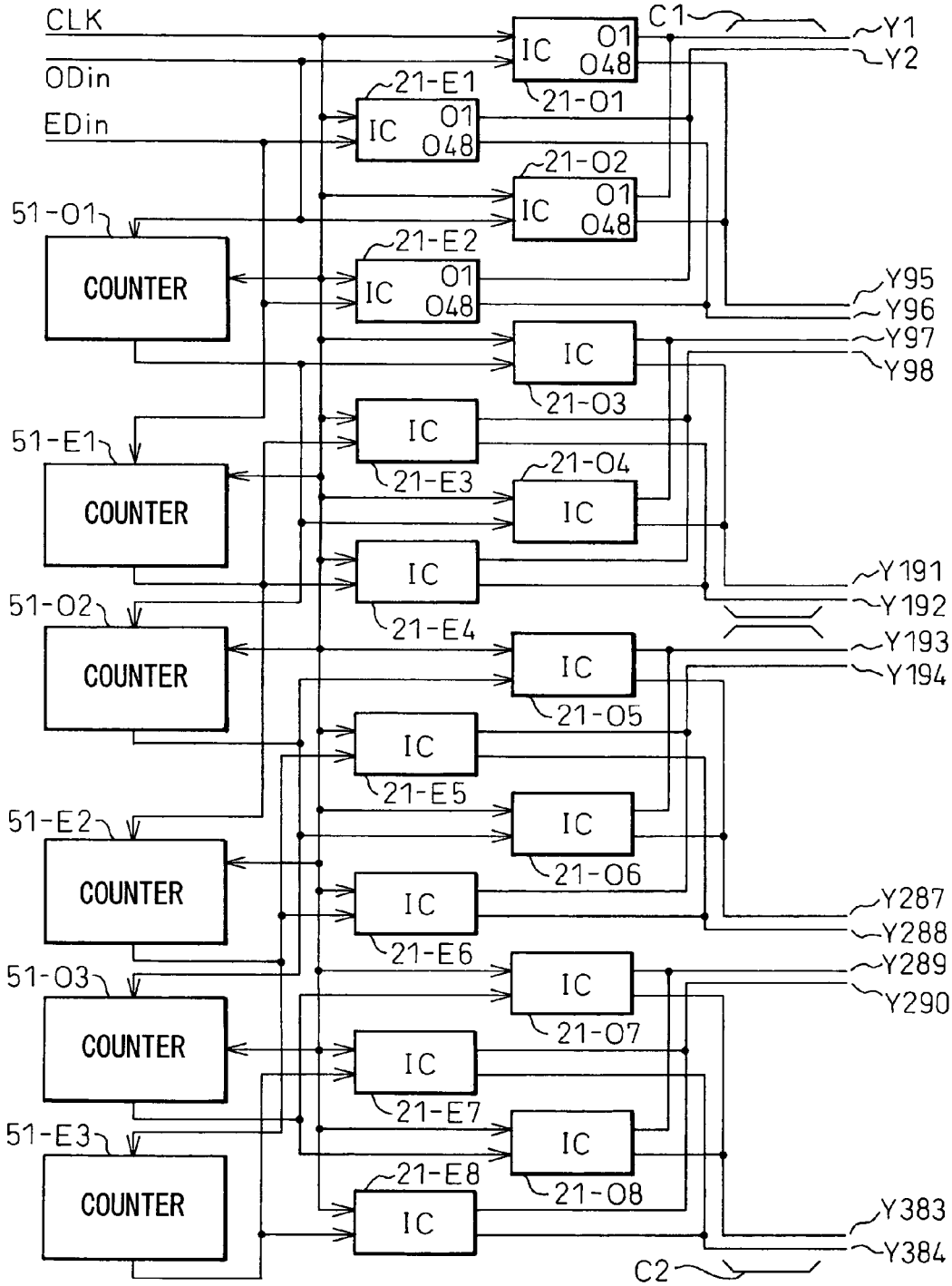
FIG. 20 is a diagram showing wiring between scan (Y) electrodes and driver IC outputs in a sixth embodiment of the present invention.

FIG. 20 is a diagram showing connection between scan (Y) electrodes and driver IC outputs in the sixth embodiment of the present invention. The PDP apparatus in the sixth embodiment employs the ALIS system, has 384 scan (Y) electrodes and two blocks each having 192 scan (Y) electrodes are connected to two groups of output terminals C1 and C2, a Y scan driver is configured by using the 64-bit driver ICs shown in FIG. 4, and two outputs of two different driver ICs are combined. As shown schematically, 16 driver ICs are used and they are divided into odd-numbered electrode driver ICs 21-01 to 21-08 and even-numbered electrode driver ICs 21-E1 to 21-E8. The respective first to forty-eighth outputs of the first odd-numbered electrode driver IC 21-01 and the respective first to forty-eighth outputs of the second odd-numbered electrode driver IC 21-02 are combined and connected to the respective odd-numbered scan electrodes Y1, Y3, . . . , Y95 of the first to ninety-sixth scan electrodes. The respective first to forty-eighth outputs of the first even-numbered electrode driver IC 21-E1 and the respective first to forty-eighth outputs of the second even-numbered electrode driver IC 21-E2 are combined and connected to the respective even-numbered scan electrodes Y2, Y4, . . . , Y96 of the first to ninety-sixth scan electrodes. In the same manner, the respective first to forty-eighth outputs of an odd-numbered driver IC and the respective first to forty-eighth outputs of the next even-numbered driver IC are combined and connected to the respective 48 scan electrodes sequentially. In the sixth embodiment, as described above, the first to forty-eighth outputs of all of the driver ICs are used and 16 outputs, that is, the forty-ninth to sixty-fourth outputs, are not used.

In order to control the driver ICs arranged as described above, three odd number counters 51-01 to 51-03 for counting 48 clocks are provided. These odd number counters can be replaced with, for example, 48-bit shift registers. Input data ODin, corresponding to one clock, to be inputted to the first and second odd-numbered electrode driver ICs 21-01 and 21-02 is inputted to the first odd number counter 51-01 and 48 clocks are counted therein. In the meantime, a shift operation up to the forty-eighth bit is performed in the odd-numbered electrode driver ICs 21-01 and 21-02. After the first odd number counter 51-01 counts 48 clocks, the carry output of the counter is inputted to the third and fourth odd-numbered electrode driver ICs 21-03 and 21-04 and to the second odd number counter 51-02. Due to this, the third and fourth odd-numbered electrode driver ICs 21-03 and 21-04 perform the shift operation and output a scan pulse sequentially and at the same time, the second odd number counter 51-02 counts 48 clocks. By the way, the first and second odd-numbered electrode driver ICs 21-01 and 21-02 keep on performing the shift operation and output a scan pulse to the forty-ninth and subsequent outputs after completing the shift operation up to the forty-eighth bit, but as these outputs are not connected, no drive load is produced and the amount of produced heat can be ignored, no problem will be brought about.

In this manner, the operation is continued until a scan pulse is output to the forty-eight output of the seventh and eighth odd-numbered electrode driver ICs 21-07 and 21-08.

Similarly, three even number counters 51-E1 to 51-E3 are provided and the even-numbered electrode driver ICs 21-E1 to 21-E8 operate in the same manner.

In the sixth embodiment, as described above, some outputs are not used but these unused outputs are distributed to each of the driver ICs evenly, therefore, the unevenness in the produced heat in each driver IC can be suppressed.

The embodiments of the present invention are described as above, but the number of unused outputs of the driver ICs changes depending on the number of electrodes, the number of groups that connect electrodes and drivers and the number of terminals in one group, the number of driver IC outputs, whether an ALIS system or a normal system, etc., therefore, there can be various examples of modifications accordingly. In the embodiments describe above, the present invention is applied to the scan driver, but the present invention can also be applied to the address electrodes.

According to the present invention, as described above, it is possible to: configure a driver for a plasma display panel with a large drive capacity by using the already existing driver ICs; reduce the cost of the driver; and shorten the time required for introducing the driver commercially, because the drive conditions of the driver ICs can be improved. Due to this, it will become easier to commercially introduce a PDP apparatus having a larger-sized plasma display panel.

We claim:

1. A plasma display apparatus, comprising:

a plurality of electrodes; and a drive circuit driving the plurality of electrodes, wherein the drive circuit has at least one driver IC having a plurality of outputs capable of outputting a plurality of drive signals independently and drives one of the electrodes by combining the plurality of outputs of the driver IC, wherein the plurality of drive signals for driving the one of the electrodes are output from the same driver IC, wherein the driver IC comprises a shift register for shifting input data sequentially in accordance with a clock, a latch circuit for latching and outputting the output of the shift register in accordance with a latch signal, and a plurality of drivers for outputting a drive signal in accordance with each output of the latch circuit, and wherein the input data is inputted successively for a length of the clocks corresponding to the number of the drive signals to be combined and the latch signal is issued at every clocks corresponding to the number of the drive signals to be combined.

2. The plasma display apparatus as set forth in claim 1, wherein the drive circuit comprises a plurality of identical driver ICs having a plurality of outputs capable of outputting a plurality drive signals independently, some of the plurality of outputs of the plurality of driver ICs are not used, and the number of unused outputs in each of the plurality of driver ICs is substantially the same.

3. The plasma display apparatus as set forth in claim 2, wherein a counter for counting the number of shifts corresponding to the number of outputs used in the shift register of each driver IC is comprised and the counter controls so that, after the output corresponding to the number of the outputs by the previous driver IC is completed, the next driver IC starts outputting.

4. A plasma display apparatus, comprising:

a plurality of electrodes; and a drive circuit driving the plurality of electrodes, wherein the drive circuit has at least one driver IC having a plurality of outputs capable of outputting a plurality of drive signals independently and drives one of the electrodes by combining the plurality of outputs of the driver IC, wherein the plurality of drive signals for driving the one of the electrodes are output from the same driver IC, wherein the driver IC comprises a shift register for shifting input data sequentially in accordance with a clock, a latch circuit for latching and outputting the output of the shift register in accordance with a latch signal, and a plurality of drivers for outputting a drive signal in accordance with each output of the latch circuit, and wherein the input data is inputted successively for a length of the clocks corresponding to the number of the drive signals to be combined and the latch signal is issued when all the input data is ready at the output of the shift register.

5. A plasma display apparatus, comprising:

a plurality of electrodes; and a drive circuit driving the plurality of electrodes, wherein the drive circuit comprises a plurality of identical driver ICs having a plurality of outputs capable of outputting a plurality drive signals independently, some of the plurality of outputs of the plurality of driver ICs are not used, and the number of unused outputs in each of the plurality of driver ICs is substantially the same.

6. The plasma display apparatus as set forth in claim 5, wherein the driver IC comprises a shift register for shifting input data sequentially in accordance with a clock, a latch circuit for latching and outputting the output of the shift register in accordance with a latch signal, and a plurality of drivers for outputting a drive signal in accordance with each output of the latch circuit.

7. A plasma display apparatus, comprising a plurality of electrodes and a drive circuit for driving the plurality of electrodes, wherein the drive circuit has a plurality of identical driver ICs having a plurality of outputs capable of outputting a plurality of drive signals independently, some of the plurality of outputs of the plurality of driver ICs are not used, and the number of unused outputs in each of the plurality of driver ICs is substantially the same.

8. The plasma display apparatus as set forth in claim 7, wherein the electrode to be driven by combining the plurality of drive signals is a scan electrode, which makes a pair of electrodes which a sustain discharge is caused to occur, and to which a scan pulse is applied during addressing.

9. The plasma display apparatus as set forth in claim 8, wherein the driver IC comprises a shift register for shifting input data sequentially in accordance with a clock, a latch circuit for latching and outputting the output of the shift register in accordance with a latch signal, and a plurality of drivers for outputting a drive signal in accordance with each output of the latch circuit.

10. The plasma display apparatus as set forth in claim 9, wherein a counter for counting the number of shifts corresponding to the number of outputs used in the shift register of each driver IC is comprised and the counter controls so that after the output corresponding to the number of the outputs by the previous driver IC is completed, the next driver IC starts outputting.

11. The plasma display apparatus as set forth in claim 7, wherein a plurality of common sustain electrodes and a plurality of scan electrodes are arranged by turns and display lines are defined between all of the respective common sustain electrodes and all of the respective scan electrodes.

* * * * *

UNITED STATES PATENT AND TRADEMARK OFFICE

CERTIFICATE OF CORRECTION

PATENT NO. : 7,598,929 B2
APPLICATION NO. : 10/900342
DATED : October 6, 2009
INVENTOR(S) : Ohnuki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1377 days.

Signed and Sealed this

Fourteenth Day of December, 2010

David J. Kappos

David J. Kappos
*Director of the United States Patent and Trademark Office*